US011263977B2

(12) United States Patent
Kim et al.

(10) Patent No.: US 11,263,977 B2
(45) Date of Patent: Mar. 1, 2022

(54) DISPLAY DEVICE

(71) Applicant: LG Display Co., Ltd., Seoul (KR)

(72) Inventors: Dongju Kim, Paju-si (KR); Minki Kim, Paju-si (KR); Inho Yeo, Paju-si (KR); Juno Hur, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/111,179

(22) Filed: Dec. 3, 2020

(65) Prior Publication Data

US 2021/0183318 A1 Jun. 17, 2021

(30) Foreign Application Priority Data

Dec. 13, 2019 (KR) ..... 10-2019-0167004

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0243* (2013.01); *G09G 2310/0283* (2013.01); *G09G 2310/0286* (2013.01); *G09G 2310/0289* (2013.01); *G09G 2310/08* (2013.01)

(58) Field of Classification Search
CPC ..... G09G 3/3266; G09G 3/3275; G09G 2310/0243; G09G 2310/0289; G09G 2310/0286; G09G 2310/0283; G09G 2310/08; G09G 3/3233; G09G 3/3208; G09G 3/007; G09G 3/2092; G09G 2310/061
See application file for complete search history.

(56) References Cited

U.S. PATENT DOCUMENTS 8,344,989 B2 * 1/2013 Kim ..... G09G 3/3677 345/100
8,571,169 B2 * 10/2013 Tobita ..... G09G 3/3677 377/64
8,692,757 B2 * 4/2014 Bang ..... G09G 3/3648 345/99

(Continued)

OTHER PUBLICATIONS

European Patent Office, Extended European Search Report, EP Patent Application No. 20210896.5, dated Mar. 29, 2021, ten pages.

*Primary Examiner* — Michael J Jansen, II
(74) *Attorney, Agent, or Firm* — Fenwick & West LLP

(57) ABSTRACT

Disclosed is a display device including: a display panel; a timing controller generating image data corresponding to an input image, and generating and outputting a first start signal, an on clock, and an off clock; a level shifter generating a second start signal in synchronization with the first start signal, generating gate clocks that swing to a predetermined voltage and have multiple phases, by using the on clock and the off clock, and outputting the generated gate clocks; a shift register including multiple stages connected to gate lines of the display panel, respectively, and outputting a scan signal sequentially to the gate lines by using the second start signal and the gate clocks; and a data driving circuit supplying a data voltage corresponding to the image data to data lines of the display panel in synchronization with the scan signal.

15 Claims, 19 Drawing Sheets

(56) References Cited

U.S. PATENT DOCUMENTS 8,860,650 B2 * 10/2014 Jang ..... G11C 19/00 345/100
8,982,033 B2 * 3/2015 Ochiai ..... G11C 19/184 345/100
9,076,403 B2 * 7/2015 Ochiai ..... G09G 3/3677
9,275,591 B2 * 3/2016 Bang ..... G09G 3/3677
9,275,599 B2 * 3/2016 Pyun ..... G09G 3/3696
9,704,431 B2 * 7/2017 Cho ..... G09G 3/3225
10,262,579 B2 * 4/2019 Zeng ..... G09G 3/3648
10,573,225 B2 * 2/2020 Lee ..... G09G 3/2092
10,598,963 B2 * 3/2020 Kim ..... G11C 19/28
2007/0296682 A1 * 12/2007 Hwang ..... G11C 19/00 345/100
2009/0167668 A1 * 7/2009 Kim ..... G11C 19/28 345/100
2010/0220079 A1 * 9/2010 Bang ..... G09G 3/3696 345/204
2010/0325466 A1 * 12/2010 Ohta ..... G09G 3/3677 713/400
2011/0001752 A1 * 1/2011 Ohta ..... G11C 19/28 345/530
2011/0222645 A1 * 9/2011 Tobita ..... G11C 19/28 377/78
2012/0013585 A1 * 1/2012 Jang ..... G11C 19/00 345/208
2013/0249781 A1 9/2013 Park
2014/0160110 A1 * 6/2014 Bang ..... G09G 3/3648 345/213
2014/0340293 A1 * 11/2014 Ochiai ..... G09G 3/3677 345/98
2014/0340294 A1 * 11/2014 Ochiai ..... G09G 3/3674 345/100
2014/0347341 A1 * 11/2014 Pyun ..... G09G 3/3696 345/212
2016/0078804 A1 * 3/2016 Cho ..... G09G 3/20 345/213
2018/0096645 A1 * 4/2018 Lee ..... G09G 3/2092
2018/0096646 A1 * 4/2018 Zeng ..... G09G 3/3688
2018/0149889 A1 * 5/2018 Kim ..... G09G 3/22
2021/0142714 A1 * 5/2021 Sung ..... G09G 3/2092

* cited by examiner

FIG. 3A

| GIP Driving | Model Vertical Resolution N | CLK Scan | | | |
|---|---|---|---|---|---|
| | | Scan | Start dummy | Real | End dummy |
| 4 Phases | N=4xn | FWD | 3-4- | 1-2-3-4- · · · -1-2-3-4 | -1-2-3-4 |
| | | REV | 2-1- | 4-3-2-1- · · · -4-3-2-1 | -4-3-2-1 |
| | N=4xn+1 | FWD | 3-4- | 1-2-3-4- · · · -1-2-3-4-1 | -2-3-4-1 |
| | | REV | 3-2- | 1-4-3-2- · · · -1-4-3-2-1 | -4-3-2-1 |
| | N=4xn+2 | FWD | 3-4- | 1-2-3-4- · · · -1-2-3-4-1-2 | -3-4-1-2 |
| | | REV | 4-3- | 2-1-4-3- · · · -2-1-4-3-2-1 | -4-3-2-1 |
| | N=4xn+3 | FWD | 3-4- | 1-2-3-4- · · · -1-2-3-4-1-2-3 | -4-1-2-3 |
| | | REV | 1-4- | 3-2-1-4- · · · -3-2-1-4-3-2-1 | -4-3-2-1 |

FIG. 3B

| GIP Driving | Model Vertical Resolution N | CLK Scan | | | |
|---|---|---|---|---|---|
| | | Scan | Start dummy | Real | End dummy |
| 8 Phases | N=8xn | FWD | 1-2-3-4-5-6-7-8- | 1-2-3-4-5-6-7-8- · · · -1-2-3-4-5-6-7-8 | -1-2-3-4-5-6-7-8 |
| | | REV | 8-7-6-5-4-3-2-1- | 8-7-6-5-4-3-2-1- · · · -8-7-6-5-4-3-2-1 | -8-7-6-5-4-3-2-1 |
| | N=8xn+1 | FWD | 1-2-3-4-5-6-7-8- | 1-2-3-4-5-6-7-8- · · · -1-2-3-4-5-6-7-8-1 | -2-3-4-5-6-7-8-1 |
| | | REV | 1-8-7-6-5-4-3-2- | 1-8-7-6-5-4-3-2- · · · -1-8-7-6-5-4-3-2-1 | -8-7-6-5-4-3-2-1 |
| | N=8xn+2 | FWD | 1-2-3-4-5-6-7-8- | 1-2-3-4-5-6-7-8- · · · -1-2-3-4-5-6-7-8-1-2 | -3-4-5-6-7-8-1-2 |
| | | REV | 2-1-8-7-6-5-4-3- | 2-1-8-7-6-5-4-3- · · · -2-1-8-7-6-5-4-3-2-1 | -8-7-6-5-4-3-2-1 |
| | N=8xn+3 | FWD | 1-2-3-4-5-6-7-8- | 1-2-3-4-5-6-7-8- · · · -1-2-3-4-5-6-7-8-1-2-3 | -4-5-6-7-8-1-2-3 |
| | | REV | 3-2-1-8-7-6-5-4- | 3-2-1-8-7-6-5-4- · · · -3-2-1-8-7-6-5-4-3-2-1 | -8-7-6-5-4-3-2-1 |
| | N=8xn+4 | FWD | 1-2-3-4-5-6-7-8- | 1-2-3-4-5-6-7-8- · · · -1-2-3-4-5-6-7-8-1-2-3-4 | -5-6-7-8-1-2-3-4 |
| | | REV | 4-3-2-1-8-7-6-5- | 4-3-2-1-8-7-6-5- · · · -4-3-2-1-8-7-6-5-4-3-2-1 | -8-7-6-5-4-3-2-1 |
| | N=8xn+5 | FWD | 1-2-3-4-5-6-7-8- | 1-2-3-4-5-6-7-8- · · · -1-2-3-4-5-6-7-8-1-2-3-4-5 | -6-7-8-1-2-3-4-5 |
| | | REV | 5-4-3-2-1-8-7-6- | 5-4-3-2-1-8-7-6- · · · -5-4-3-2-1-8-7-6-5-4-3-2-1 | -8-7-6-5-4-3-2-1 |
| | N=8xn+6 | FWD | 1-2-3-4-5-6-7-8- | 1-2-3-4-5-6-7-8- · · · -1-2-3-4-5-6-7-8-1-2-3-4-5-6 | -7-8-1-2-3-4-5-6 |
| | | REV | 6-5-4-3-2-1-8-7- | 6-5-4-3-2-1-8-7- · · · -6-5-4-3-2-1-8-7-6-5-4-3-2-1 | -8-7-6-5-4-3-2-1 |
| | N=8xn+7 | FWD | 1-2-3-4-5-6-7-8- | 1-2-3-4-5-6-7-8- · · · -1-2-3-4-5-6-7-8-1-2-3-4-5-6-7 | -8-1-2-3-4-5-6-7 |
| | | REV | 7-6-5-4-3-2-1-8- | 7-6-5-4-3-2-1-8- · · · -7-6-5-4-3-2-1-8-7-6-5-4-3-2-1 | -8-7-6-5-4-3-2-1 |

DISPLAY DEVICE

CROSS REFERENCE TO RELATED APPLICATION

The present application claims priority to Republic of Korea Patent Application No. 10-2019-0167004, filed Dec. 13, 2019, which is incorporated by reference in its entirety.

BACKGROUND

Field of Technology

The present disclosure relates to a display device. More particularly, the present disclosure relates to a display device for simplifying an interface between a controller and a level shifter.

Description of the Related Art

Flat-panel displays include a liquid crystal display (LCD), an electroluminescent display, a field-emission display (FED), a quantum dot (QD) display, and the like. An electroluminescent display is divided into an inorganic light-emitting display device and an organic light-emitting display device according to the material of an emission layer. The pixels of the organic light-emitting display device include organic light-emitting diodes (OLEDs), which are self-luminous elements, and the OLEDs emit light so that an image is displayed.

Recently, an OLED display using a plastic substrate has been adopted as a display for a vehicle, because it can be deformed to facilitate the design and display a black color well, which results in high display quality.

The display used in the vehicle may be used with the display panel upside down for vehicle manufacturer convenience. When the panel is turned upside down, a host system of the vehicle transmits a separate signal informing about this, to a timing controller of the display device. The timing controller changes timing of a signal to be transmitted to a level shifter that generates a signal required for scan driving, so that a gate driving circuit enables the display panel to drive in reverse (reverse-drive).

However, depending on the type of interface between the timing controller and the level shifter, there may be problem that start clock information is not transmitted when a scan signal of the display panel is driven in reverse or reverse-driven.

The foregoing is intended merely to aid in the understanding of the background of the present disclosure, and is not intended to mean that the present disclosure falls within the purview of the related art that is already known to those skilled in the art.

SUMMARY

An embodiment disclosed in the present disclosure takes this situation into account, and the objective of the present disclosure is to provide an interface between a timing controller and a level shifter, the interface for effectively transmitting information on whether reverse driving takes place and information on a start clock.

In addition, the objective of the present disclosure is to provide a display device employing an interface that reduces the number of signal transmission lines and pins between the timing controller and the level shifter.

According to an embodiment, there is provided a display device including: a display panel; a timing controller supplying image data of an input image, and generating and outputting a first start signal, an on clock, and an off clock; a level shifter generating a second start signal in synchronization with the first start signal, generating gate clocks that swing to a predetermined voltage and have multiple phases, by using the on clock and the off clock, and outputting the generated gate clocks; a shift register including multiple stages connected to gate lines of the display panel, respectively, and outputting a scan signal sequentially to the gate lines by using the second start signal and the gate clocks; and a data driving circuit supplying a data voltage corresponding to the image data to data lines of the display panel in synchronization with the scan signal, wherein the level shifter generates the gate clocks according to order determined on the basis of the number of pulses of the on clock or the off clock included in a vertical blank period.

According to another embodiment, there is provided a method of driving a display panel, the method including: generating, at a first step, a first start signal, an on clock, and an off clock; generating, at a second step, a second start signal in synchronization with the first start signal, and generating gate clocks that swing to a predetermined voltage and have multiple phases, by using the on clock and the off clock, wherein the gate clocks are generated according to order determined on the basis of the number of pulses of the on clock or the off clock included in a vertical blank period; and outputting, at a third step, a scan signal sequentially to gate lines of the display panel by using the second start signal and the gate clocks, and supplying a data voltage to data lines of the display panel in synchronization with the scan signal.

While a simple interface between the timing controller and the level shifter is employed, reverse driving is possible. In addition, while minimizing the number of lines and pins of the interface, the timing controller transmits information on whether reverse driving takes place and information on the start clock for reverse driving, to the level shifter.

In addition, since the interface between the timing controller and the level shifter is simplified, a panel driving chip or a PCB is reduced in size, and the bezel is reduced accordingly.

BRIEF DESCRIPTION OF THE DRAWINGS

The above and other objectives, features, and other advantages of the present disclosure will be more clearly understood from the following detailed description when taken in conjunction with the accompanying drawings, in which:

FIGS. 3A and 3B are diagrams showing a start dummy clock and a real clock in forward driving and reverse driving with each resolution when using 4-phase and 8-phase clocks, respectively according to one embodiment;

DETAILED DESCRIPTION

Figure 1:
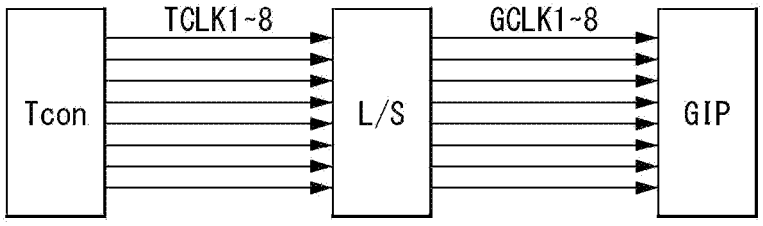
FIG. 1 is a diagram showing a direct interface method between a timing controller and a level shifter according to one embodiment.
Figure 1:
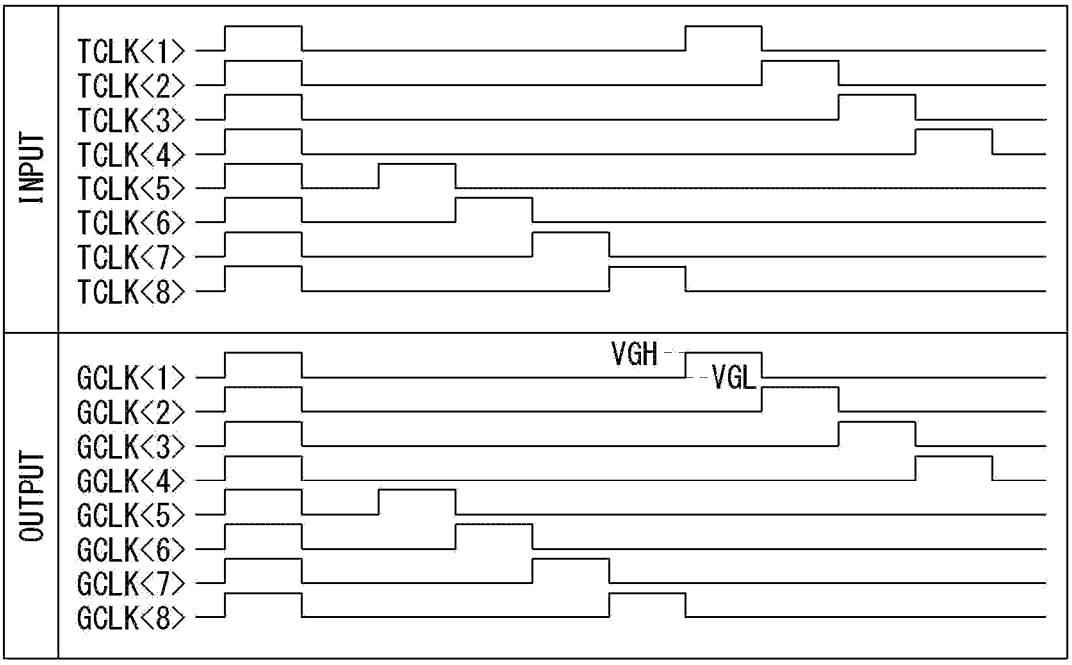

Hereinafter, embodiments of the present disclosure will be described in detail with reference to the accompanying drawings. Throughout the specification, the same reference numerals denote the substantially same elements. In the following description, when it is determined that a detailed description of known functions or configurations related with the present disclosure may obscure or interfere with understanding of the contents of the present disclosure unnecessarily, the detailed description thereof will be omitted.

Figure 2:
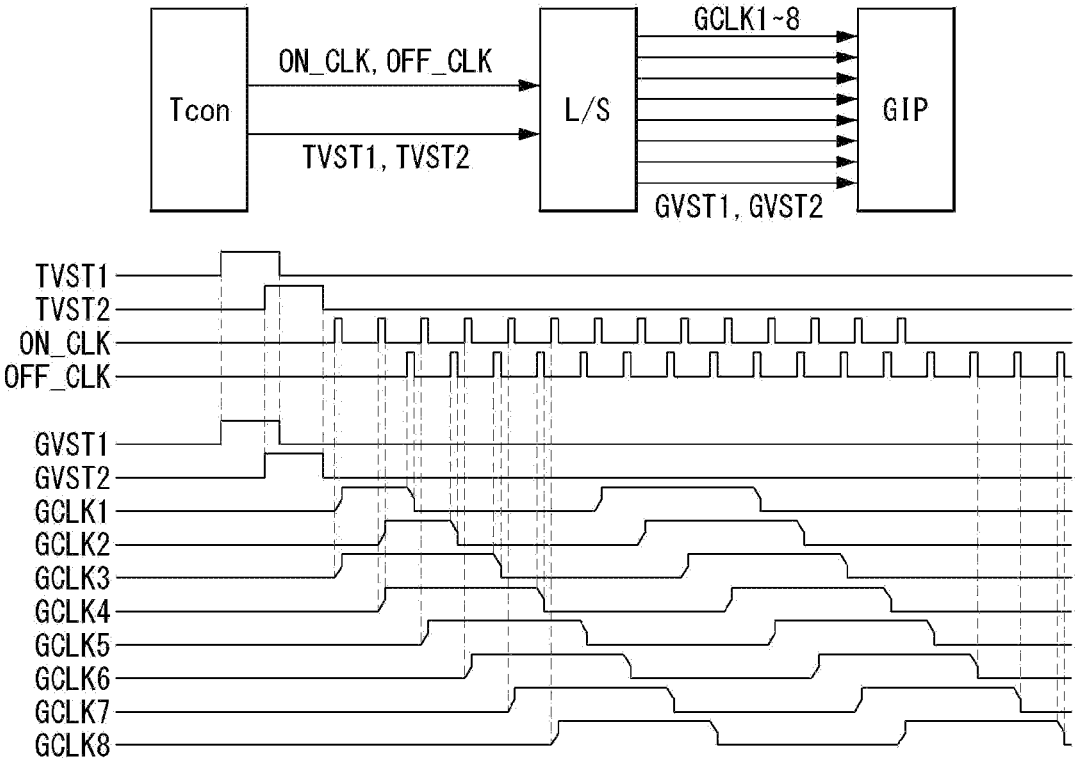
FIG. 2 is a diagram showing a simple interface method between a timing controller and a level shifter according to one embodiment.

FIG. 1 is a diagram showing a direct interface method between a timing controller and a level shifter. FIG. 2 is a diagram showing a simple interface method between a timing controller and a level shifter.

The level shifter L/S generates driving signals required for operation of a gate driving circuit (shift register), for example, a gate start signal (or gate start pulse) GVST and gate clocks GCLKs. In particular, the level shifter L/S changes the level so that the gate clocks GCLKs have levels of a gate high voltage VGH and a gate low voltage VGL that switch transistors formed in a display panel.

The gate start signal GVST is applied to a gate stage generating the first output or to a dummy stage placed in front of the gate stage generating the first output, so as to control the gate stage or the dummy stage. The gate clocks GCLKs are clock signals that are input to gate stages or dummy stages in common, to shift the gate start pulse.

In the direct interface method of FIG. 1, a timing controller Tcon directly generates timing clocks TCLK1 to TCLK8 having a low swing level and supplies the same to the level shifter L/S. The level shifter L/S raises only the swing level of the timing clocks TCLK1 to TCLK8 without changing the timing of the timing clocks TCLK1 to TCLK8 so that gate clocks GCLK1 to GCLK8 swing between the gate high voltage VGH and the gate low voltage VGL.

In FIG. 1, the timing clocks TCLK1 to TCLK 8 that the timing controller Tcon supplies are in the form of combination of a clock and a start signal informing about the start of a frame.

In the case of the direct interface method of FIG. 1, between the timing controller Tcon and the level shifter L/S, there are as many transmission lines as there are phases included in the clocks. Thus, the size of the chip or the PCB is bound to increase.

Moreover, if the number of gate lines formed in the display panel increases and accordingly phases of the clocks required to generate the scan signal (or gate signal) increase to 10 phases or more, the number of lines and the number of pins of the IC increase in the direct interface method of FIG. 1, which is a constraint in terms of cost or PCB space.

To solve this problem, the simple interface method in FIG. 2 has been employed between the timing controller and the level shifter.

When the timing controller Tcon supplies an on clock ON_CLK, an off clock OFF_CLK, and timing start signals TVST1 and TVST2 to the level shifter L/S, the level shifter L/S generates, by using the same, gate clocks GCLK1 to GCLK8 swinging between the gate high voltage VGH and the gate low voltage VGL, and gate start signals GVST1 and GVST2.

The timing start signals TVST1 and TVST2 are for informing about the start of an image frame. The on clock ON_CLK and the off clock OFF_CLK are signals for controlling timing of the gate clock GCLK. The gate clock GCLK provides timing to the shift register so that the shift register generates a scan signal used to control pixel operation.

Fundamentally, upon the rising edge of the on clock ON_CLK, the rising edge of the gate clock GCLK starts. Upon the rising edge of the off clock OFF_CLK, the falling edge of the gate clock GCLK starts.

The simple interface method of FIG. 2 only requires wires for the on clock ON_CLK, the off clock OFF_CLK, and the timing start signals TVST1 and TVST2, between the timing controller Tcon and the level shifter L/S, removing the constraint imposed in the direct interface method of FIG. 1.

However, in the simple interface method of FIG. 2, only the on clock ON_CLK and the off clock OFF_CLK are transmitted to the level shifter L/S, so the level shifter L/S is unable to distinguish between normal-phase driving (or forward driving) and reversed-phase driving (or reverse driving).

In addition, the sequences of gate clocks or start clocks applied to the shift register vary according to a scan driving direction and resolution. According to the simple interface method of FIG. 2, there is no way for the level shifter L/S to identify the scan driving direction and the start clock that needs to be transmitted first.

For reference, FIGS. 3A and 3B are diagrams showing a start dummy clock "start dummy" and a real clock "real" in forward driving and reverse driving with each resolution when using 4-phase and 8-phase clocks, respectively.

As shown in FIGS. 3A and 3B, when a scan signal is generated by using gate clocks having four or eight different phases, the sequences of gate clocks applied to the shift register may vary with each resolution and each of two driving directions, specifically, forward driving FWD and reverse driving REV.

In FIG. 3A, for example, when in the vertical direction or in the direction to which a data line progresses (the direction perpendicular to the direction to which a gate line progresses), the resolution is 4×n and forward driving FWD takes place, phase 3 and phase 4 gate clocks are supplied first to two dummy stages positioned at the uppermost side of the display panel as start dummy gate clocks.

Afterward, phase 1 to phase 4 gate clocks are supplied to the output stages positioned at the upper side of the display panel in that order.

In addition, in FIG. 3A, when the resolution is 4×n and reverse driving REV takes place, phase 2 and phase 1 gate clocks are supplied first to two dummy stages positioned at the lowermost side of the display panel as start dummy gate clocks. Afterward, phase 4 to phase 1 gate clocks are supplied to the output stages positioned at the lower side of the display panel in that order.

In FIG. 3B, for example, when in the vertical direction, the resolution is (8×n+3) and forward driving FWD takes place, phases 1-2-3-4-5-6-7-8 gate clocks are supplied to eight dummy stages positioned at the uppermost side of the display panel as start dummy gate clocks in that order. Afterward, phase 1 to phase 8 gate clocks are supplied to the output stages positioned at the upper side of the display panel in that order.

In addition, in FIG. 3B, when the resolution is (8×n+7) and reverse driving REV takes place, phases 7-6-5-4-3-2-1-8 gate clocks are supplied first to eight dummy stages positioned at the lowermost side of the display panel as start dummy gate clocks in that order. Afterward, phases 7-6-5-4-3-2-1-8 gate clocks are supplied to the output stages positioned at the lower side of the display panel in that order.

That is, in FIGS. 3A and 3B, when the number of dummy stages is changed, also the sequence of gate clocks to be supplied is changed. In the case of forward driving FWD, starting with the output stage positioned at the uppermost side of the display panel, gate clocks are supplied in ascending order, starting from phase 1. In the case of reverse driving REV, gate clocks are supplied in descending order, ending with phase 1 to the output stage positioned at the uppermost side of the display panel.

As described above, the sequences of clocks to be supplied vary according to the resolution and the scan direction of the display panel. In the simple interface of FIG. 2, there is no way for the level shifter L/S to identify the driving direction and the start clock.

Figure 4:
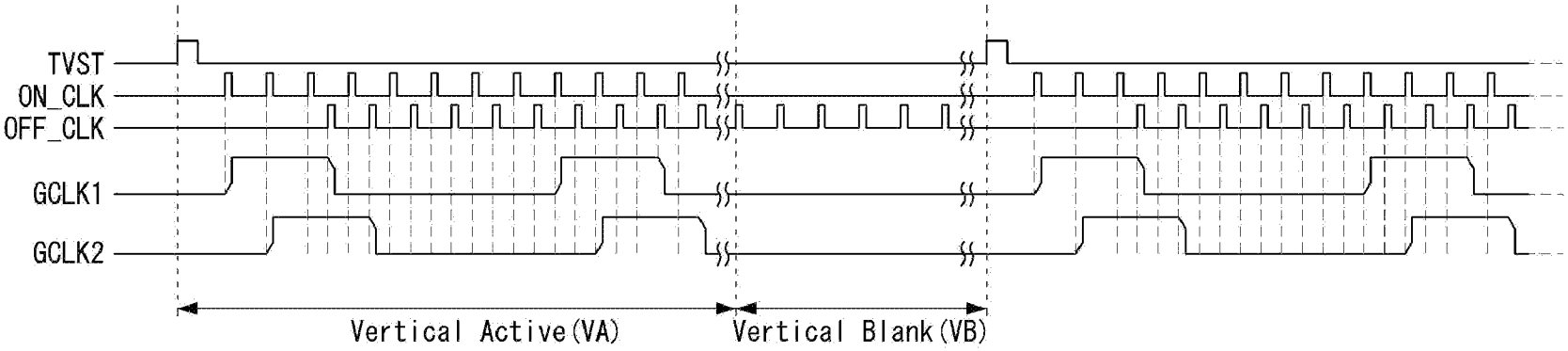
FIG. 4 is a diagram showing an embodiment in which an off clock is transmitted during a vertical blank period.

FIG. 4 is a diagram showing an embodiment in which an off clock is transmitted during a vertical blank period.

In the simple interface method, the timing controller Tcon transmits an on clock ON_CLK and an off clock OFF_CLK after a pulse of a timing start signal TVST so that the level shifter L/S generates gate clocks GCLKs during a vertical active period of a frame period.

During the vertical blank period, the shift register does not generate a gate signal. Therefore, the level shifter L/S does not need to generate gate clocks GCLKs and transmit the same to the shift register. Accordingly, the timing controller Tcon does not transmit a pulse of an on clock ON_CLK and an off clock OFF_CLK.

In the embodiment of FIG. 4, the timing controller Tcon selectively transmit an off clock OFF_CLK to the level shifter L/S in the vertical blank period, so that the level shifter L/S identifies a scan driving direction depending on whether the off clock OFF_CLK is present in the vertical blank period.

In addition, the timing controller Tcon may adjust the number of pulses of the off clock OFF_CLK included in the vertical blank period so that the level shifter L/S may identify the sequence of gate clocks GCLKs or the start clock to be transmitted to the shift register.

The level shifter L/S generates the gate clocks GCLKs in synchronization with a pulse (rising edge) of the on clock ON_CLK. Therefore, when the timing controller Tcon does not transmit the on clock ON_CLK (the pulse of the on clock) but transmits only the off clock OFF_CLK in the vertical blank period, the level shifter L/S does not unnecessarily generate the gate clock GCLKs.

In addition, when an off clock OFF_CLK is transmitted without an on clock ON_CLK, the level shifter L/S determines that the vertical blank period is in progress, counts the pulses of the off clock OFF_CLK, distinguishes between forward and reverse driving on the basis of the count value, and determines the start clock in the case of reverse driving.

The timing controller Tcon may transmit the scan driving direction and the sequence of the gate clocks GCLKs to the level shifter L/S by using the on clock ON_CLK instead of the off clock OFF_LCLK.

In this case, since the level shifter L/S generates the gate clocks GCLKs in synchronization with the pulse of the on clock ON_CLK, the level shifter L/S may ignore the pulse of the on clock ON_CLK and may not generate the gate clocks GCLKs in synchronization with the start of the vertical blank period.

Since the vertical blank period is much longer than the period of the off clock OFF_CLK, a noise is generated in the off clock (OFF_CLK) signal during the vertical blank period, and there is a concern that the level shifter L/S may incorrectly determine the scan direction or the start pulse.

To cope with this problem, the timing controller Tcon may supply an off clock OFF_CLK and a separate control signal P_DN together to the level shifter L/S in the vertical blank period so that the level shifter L/S may determine the scan direction and the start pulse by using the off clock OFF_CLK and the control signal P_DN.

That is, the level shifter L/S may determine the scan direction and the start pulse by using the number of pulses of the off clock OFF_CLK transmitted during a pulse period in which the control signal P_DN is maintained at a first level (for example, logic high).

Figure 5:
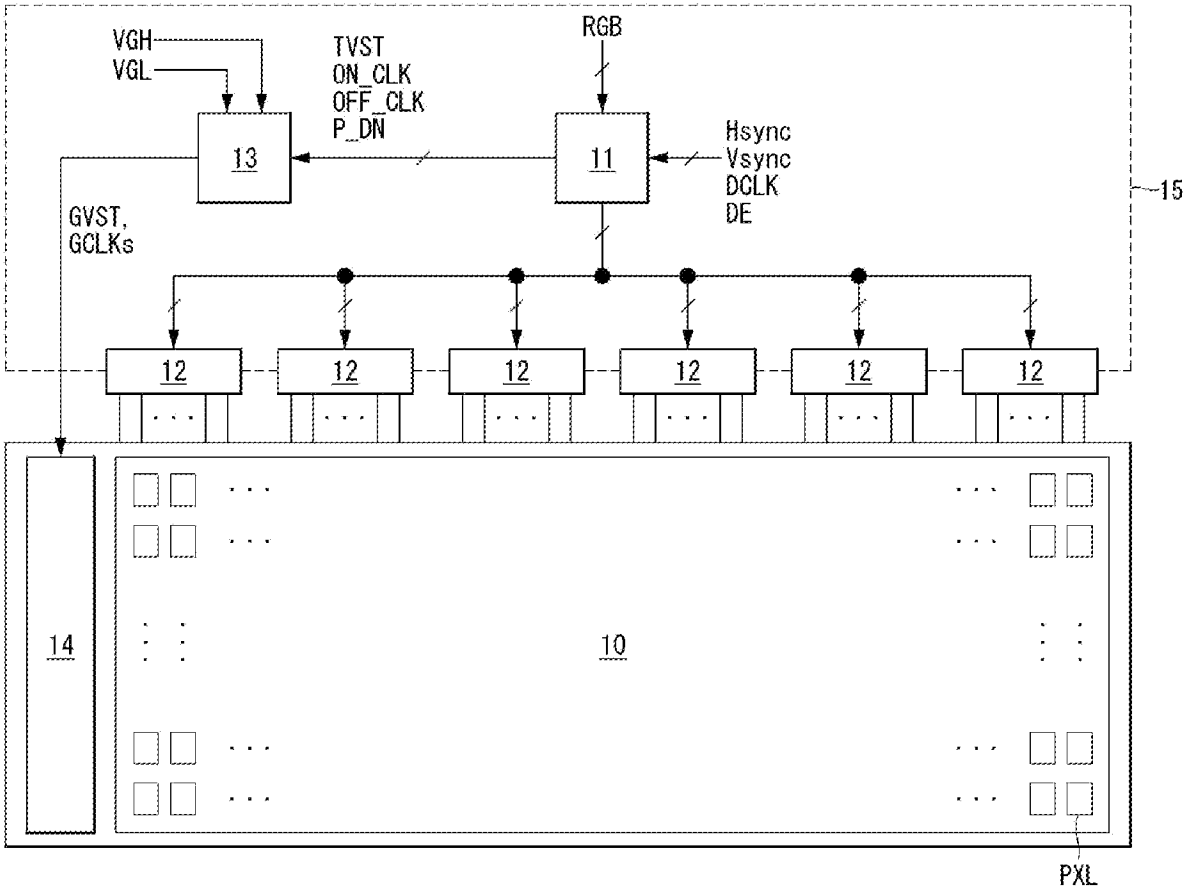
FIG. 5 is a function block diagram showing a display device according to one embodiment.

FIG. 5 is a function block diagram showing a display device. The display device of FIG. 5 may include a display panel 10, a timing controller 11, a data driving circuit 12, a level shifter 13, and a shift register 14.

Some or all of the timing controller 11, the data driving circuit 12, the level shifter 13, and the shift register 14 of FIG. 5 may be integrated within a driver IC. The data driving circuit 12, the level shifter 13, and the shift register 14 may be combined to construct one driving circuit. The level shifter 13 and the shift register 14 may constitute the gate driving circuit. The timing controller 11, the data driving circuit 12, and the level shifter 13 may be mounted on the PCB 15.

Regarding the display panel 10, on a screen where an input image is displayed, multiple data lines DLs arranged in the column direction (or vertical direction) and multiple gate lines GLs arranged in the row direction (or horizontal direction) intersect, and pixels PXLs at respective intersection regions are arranged in a matrix form so that a pixel array is formed.

In the display panel 10 where light-emitting pixels are arranged, a pixel array is formed in a display area on a substrate, an encapsulation layer covering the pixel array is placed, and a sealant is applied to a non-display area on the substrate so that external impact is cushioned and moisture is prevented from invading the pixel array.

The gate lines GLs may include a first gate line GL_1 and a second gate line GL_2. The first gate line GL_1 supplies a scan signal for applying a data voltage to be supplied to a data line DL, to the pixel, and the second gate line GL_2 supplies a light-emission signal for causing a pixel to which a data voltage is written, to emit light The display panel 10 may further include a first power line, a second power line, an initialization voltage line, and the like. The first power line is for supplying a pixel driving voltage (or high-potential power supply voltage) Vdd to the pixels PXLs. The second power line is for supplying a low-potential power supply voltage Vss to the pixels PXLs. The initialization voltage line is for supplying an initialization voltage Vini to initialize the pixel circuit. The first/second power line and the initialization voltage line may be connected to a power supply unit (not shown). The second power line may be formed in the form of transparent electrode covering multiple pixels PXLs.

On the pixel array of the display panel 10, touch sensors may be arranged. Touch input may be sensed by using separate touch sensors or through pixels. The touch sensors may be implemented as on-cell-type or add-on-type touch sensors arranged on a screen (AA) of the display panel (10), or may be implemented as in-cell-type touch sensors embedded in the pixel array.

In the pixel array, the pixels PXLs arranged in the same horizontal line access any one of the data lines DLs, any one of the gate lines GLs (or any one of the first gate lines GL_1 and any one of the second gate lines GL_2) so that a pixel line is formed.

The pixel PXL including a light-emitting element is electrically connected to the data line DL in response to the scan signal and the light-emission signal applied through the gate line GL, receives a data voltage, and causes an OLED, which is a light-emitting element, with a current corresponding to the data voltage. The pixels PXLs arranged in the same pixel line may operate simultaneously according to the scan signal and the light-emission signal applied from the same gate line GL.

A pixel PXL of an organic light-emitting display device includes an OLED, which is a light-emitting element, and a driving element driving the OLED by supplying a current to the OLED according to a gate-source voltage Vgs. The OLED include an anode, a cathode, and an organic compound layer formed between these electrodes.

The organic compound layer may include a hole injection layer (HIL), a hole transport layer (HTL), an emission layer (EML), an electron transport layer (ETL), an electron injection layer (EL), and the like, but it is not limited thereto. When a current flows into the OLED, holes passed through the hole transport layer (HTL) and electrons passed through the electron transport layer (ETL) move to the emission layer (EML) and excitons are thus formed. Consequently, the emission layer (EML) may emit visible light.

One-pixel unit may be composed of three subpixels including a red subpixel, a green subpixel, and a blue subpixel, or four sub-pixels including a red subpixel, a green subpixel, a blue subpixel, and a white subpixel, but this is not limited thereto. Each subpixel may be implemented as a pixel circuit including an internal compensation circuit. Hereinafter, a pixel refers to a subpixel.

Figure 6:
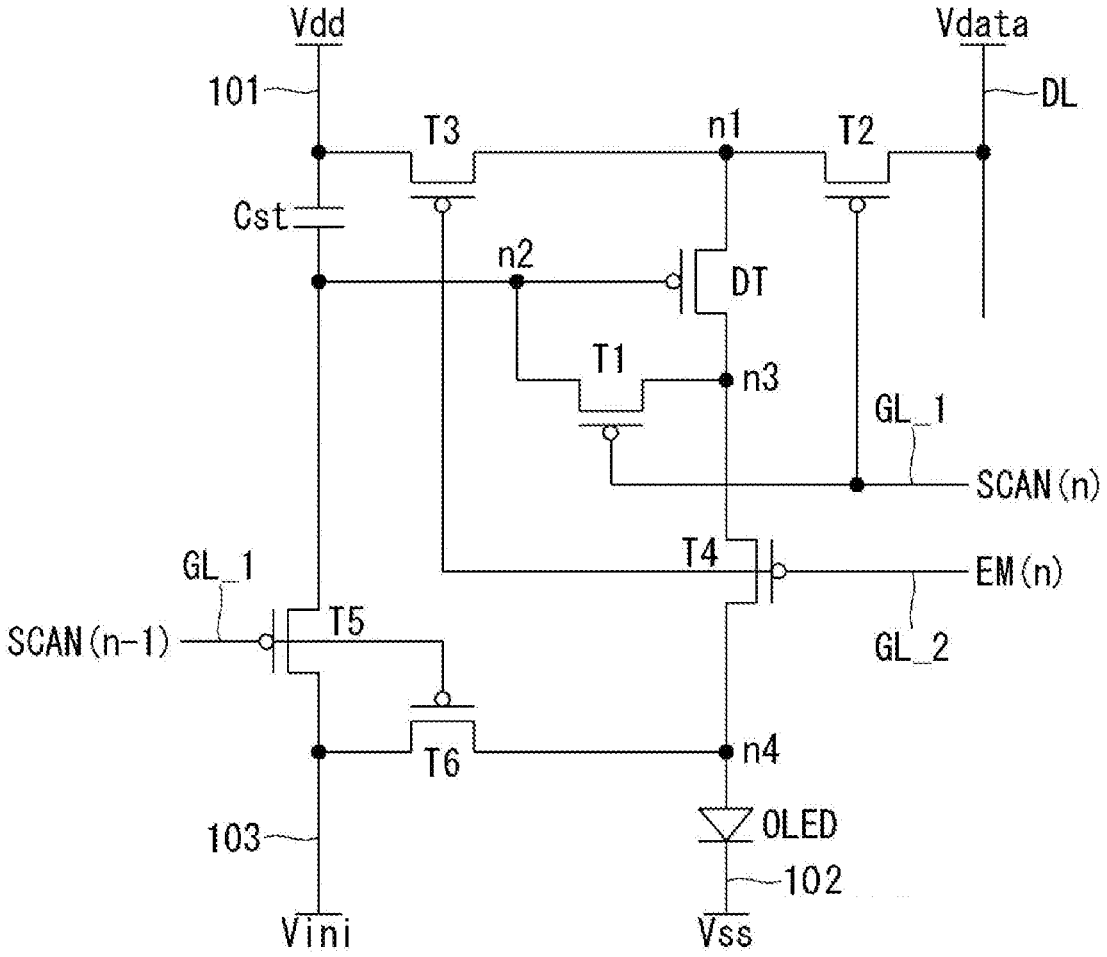
FIG. 6 is a diagram showing an equivalent circuit of a pixel included in an OLED display panel according to one embodiment.

The pixel PXL may receive, from a power supply unit (not shown), a pixel driving voltage Vdd, an initialization voltage Vini, and a low-potential power supply voltage Vss, and may include a driving transistor, an OLED, and an internal compensation circuit. The internal compensation circuit may be composed of multiple switch transistors and one or more capacitors as shown in FIG. 6 which will be described below.

The timing controller 11 receives, from a host system (not shown), a timing signal such as a vertical synchronization signal Vsync, a horizontal synchronization signal Hsync, a data enable signal DE, a dot clock DCLK, and the like, and generates control signals for controlling operation timing of the data driving circuit 12 and the level shifter 13. The control signals include a data control signal for controlling operation timing of the data driving circuit 12, and a gate control signal for controlling operation timing of the gate driving circuit including the level shifter 13 and the shift register 14.

The data driving circuit 12 performs, on the basis of the data control signal, sampling and latch operation on digital video data (RGB) input from the timing controller 11, thus converts the digital video data into parallel data, converts the resulting data into an analog data voltage according to a gamma reference voltage through channels, and supplies the data voltage to pixels PXLs through an output channel and the data lines DL. The data voltage may be a value corresponding to the grayscale to be displayed by a pixel. The data driving circuit 12 may be composed of multiple source driver ICs.

Each of the source driver ICs constituting the data driving circuit 12 may include a shift register, a latch, a level shifter, a DAC, and a buffer. The shift register shifts a clock input from the timing controller 11 and sequentially outputs clocks for sampling. The latch samples digital video data or pixel data with timing of the clocks for sampling sequentially input from the shift register, performs latch operation, and outputs the sampled pixel data simultaneously. The level shifter shifts the voltage of the pixel data input from the latch, into a range of input voltages of the DAC. The DAC converts the pixel data from the level shifter to a data voltage on the basis of a gamma compensation voltage, and outputs the data voltage. The data voltage output from the DAC is supplied to the data line DL through the buffer.

The gate driving circuit generates a scan signal and a light-emission signal on the basis of the gate control signal. In an active period, the gate driving circuit generates scan signals and light-emission signals in a row-sequential manner, and provides the resulting signals sequentially to the gate lines GLs connected to the respective pixel lines. The scan signal and the light-emission signal in the gate line GL is synchronized with supply of the data voltage in the data line DL. The scan signal and the light-emission signal swing between a gate-on voltage and a gate-off voltage.

The level shifter 13 of the gate driving circuit generates gate clocks GCLKs swinging between the gate high voltage VGH and the gate low voltage VGL, by using an on clock ON_CLK and an off clock OFF_CLK input from the timing controller 11. The gate clocks GCLKs may be configured as i (i is a positive integer equal to or greater than 2)-phase clocks having a predetermined phase difference.

The level shifter 13 may determine whether the direction in which scanning of the display panel 10 takes place is forward driving or reverse driving, on the basis of whether a pulse of the off clock OFF_CLK is transmitted during the vertical blank (VB) period. In addition, the level shifter 13 may determine the sequence of the gate clocks GCLKs or the start clock, by counting the number of pulses of the off clock OFF_CLK during the vertical blank (VB) period. This will be described in detail below.

The shift register 14 of the gate driving circuit generates a scan pulse of the scan signal and/or a light-emission pulse of the light-emission signal by shifting the gate clocks GCLKs input from the level shifter 13, and supplies the resulting pulses sequentially to the gate lines GL.

The gate driving circuit may be directly formed on a lower substrate of the display panel 10 in a gate-driver-IC-in-panel (GIP) manner. The level shifter 13 may be mounted on a printed circuit board (PCB), and the shift register may be formed on the lower substrate of the display panel 10.

The power supply unit (not shown) adjusts a DC input voltage provided from the host system, by using a DC-DC converter, and thus generates a gate-on voltage, a gate-off voltage, and the like required for operation of the timing controller 11, the data driving circuit 12, the level shifter 13, and the shift register 14. In addition, the power supply unit generates a pixel driving voltage Vdd, an initialization voltage Vini, a low-potential power supply voltage Vss, and the like required for operation of the pixel array.

The host system may be an application processor (AP) in a mobile device, a wearable device, a virtual/augmented reality device, and the like. Alternatively, the host system may be a main board of a television system, a set-top box, a navigation system, a personal computer, a home theater system, and the like, but is not limited thereto.

Figure 7:
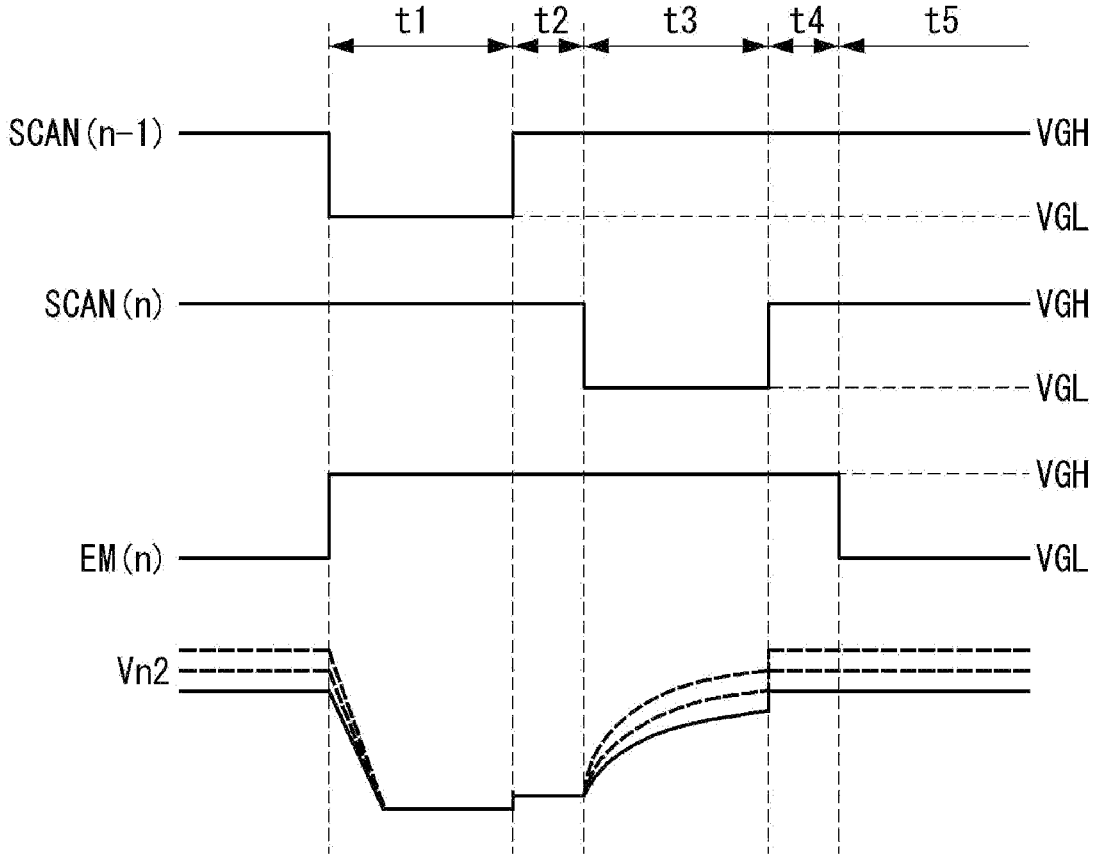
FIG. 7 is a diagram showing signals related to driving in a pixel circuit of FIG. 6 according to one embodiment.

FIG. 6 is a diagram showing an equivalent circuit of a pixel included in an OLED display panel. FIG. 7 is a diagram showing signals related to driving in a pixel circuit of FIG. 6. The pixel circuit of FIG. 6 is merely an example, and a pixel circuit to which an embodiment of the present disclosure is applied is not limited to the pixel circuit of FIG. 6.

The pixel circuit of FIG. 6 includes a light-emitting element (OLED), a driving element DT supplying a current to the light-emitting element (OLED), and an internal compensation circuit composed of multiple switch transistors T1 to T6, and a storage capacitor Cst. The pixel circuit samples a threshold voltage Vth of the driving element DT and applies compensation for the threshold voltage Vth of the driving element DT to the gate voltage of the driving element DT. The driving element DT and each of the switch transistors T1 to T6 may be implemented as P-channel transistors, but are not limited thereto. In the case of the P-channel transistor, the gate-on voltage may be the gate low voltage VGL, and the gate-off voltage may be the gate high voltage VGH.

The pixel circuit of FIG. 6 is for a pixel placed in an n-th horizontal line (or pixel line). The operation of the pixel circuit of FIG. 6 may be roughly divided into an initialization period t1, a sampling period t3, a data writing period t4, and a light-emission period t5.

In the initialization period t1, an (n−1)-th scan signal SCAN(n−1) for supplying a data voltage to pixels in an (n−1)-th horizontal line is applied with the gate-on voltage VGL, so that a fifth and a sixth switch transistor T5 and T6 are turned on, and the pixel circuit is initialized accordingly. After the initialization period t1, a hold period t2 in which the voltage of the (n−1)-th scan signal SCAN(n−1) is changed from the gate-on voltage VGL to the gate-off voltage VGH is placed before an n-th scan signal SCAN(n) for controlling supply of data to the current horizontal line is applied with the gate-on voltage VGL. However, the hold period t2 corresponding to the second period may be omitted.

In the sampling period t3, the n-th scan signal SCAN(n) for controlling supply of data to the current horizontal line is applied with the gate-on voltage VGL, so that a first and a second switch transistor T1 and T2 are turned on and the threshold voltage of the driving element (or driving transistor) DT is thus sampled and is stored in the storage capacitor Cst.

In the data writing period t4, the n-th scan signal SCAN(n) is applied with the gate-off voltage VGH, so that the first and the second switch transistor T1 and T2 are turned off and also the remaining switch transistors T3 to T6 are turned off. Due to the current flowing in the driving transistor DT, a voltage of a gate electrode of the driving transistor DT is increased.

In the light-emission period t5, an n-th light-emission signal EM(n) is applied with the gate-on voltage VGL, so that the third and the fourth switch transistor T3 and T4 are turned on and the light-emitting element (OLED) thus emits light Or else, in order to accurately display the luminance of low grayscale by using a duty ratio of the light-emission signal EM(n), the light-emission signal EM(n) is caused to swing between the gate-on voltage VGL and the gate-off voltage VGH at a predetermined duty ratio during the light-emission period t5 so that the third and the fourth switch transistor T3 and T4 repeat on/off operation.

An anode electrode of the light-emitting element (OLED) is connected to a fourth node n4 between the fourth and the sixth switch transistor T4 and T6. The fourth node n4 is connected to the anode electrode of the light-emitting element (OLED), a second electrode of the fourth switch transistor T4, and a second electrode of the sixth switch transistor T6. A cathode electrode of the light-emitting element (OLED) is connected to a second power line 102 through which the low-potential power supply voltage Vss is applied. The light-emitting element OLED emits light with the current flowing according to the gate-source voltage Vgs of the driving element DT. The flow of the current in the light-emitting element (OLED) is switched by the third and the fourth switch transistor T3 and T4.

The storage capacitor Cst is connected between the first power line 102 and a second node n2. The storage capacitor Cst is charged with the data voltage Vdata to which compensation for the threshold voltage Vth of the driving element DT is applied. In each of the pixels, since compensation for the threshold voltage Vth of the driving element DT is applied to the data voltage Vdata, it is possible to compensate for the variations in characteristic between the driving elements DTs of the pixels.

The first switch transistor T1 is turned on in response to the gate-on voltage VGL of the n-th scan signal SCAN(n), and connects the second node n2 and a third node n3. The second node n2 is connected to a gate electrode of the driving element DT, a first electrode of the storage capacitor Cst, and a first electrode of the first switch transistor T1. The third node n3 is connected to a second electrode of the driving element DT, a second electrode of the first switch transistor T1, and a first electrode of the fourth switch transistor T4. A gate electrode of the first switch transistor T1 is connected to a first gate line GL_1 and thus receives the n-th scan signal SCAN(n). The first electrode of the first switch transistor T1 is connected to the second node n2, and the second electrode of the first switch transistor T1 is connected to the third node n3.

The second switch transistor T2 is turned on in response to the gate-on voltage VGL of the n-th scan signal SCAN(n) and supplies the data voltage Vdata to the first node n1. A gate electrode of the second switch transistor T2 is connected to a first gate line 31 and thus receives the n-th scan signal SCAN(n). A first electrode of the second switch transistor T2 is connected to the data line DL through which the data voltage Vdata is applied. A second electrode of the second switch transistor T2 is connected to the first node nl. The first node n1 is connected to the second electrode of the second switch transistor T2, a second electrode of the third switch transistor T3, and a first electrode of the driving element DT.

The third switch transistor T3 is turned on in response to the gate-on voltage VGL of the light-emission signal EM(n) and connects a first power line 101 to the first node nl. A gate electrode of the third switch transistor T3 is connected to a second gate line GL_2 and thus receives the light-emission signal EM(n). A first electrode of the third switch transistor T3 is connected to the first power line 101. The second electrode of the third switch transistor T3 is connected to the first node n1.

The fourth switch transistor T4 is turned on in response to the gate-on voltage VGL of the light-emission signal EM(n) and connects the third node n3 to the anode electrode of the light-emitting element (OLED). A gate electrode of the fourth switch transistor T4 is connected to the second gate line GL_2 and thus receives the light-emission signal EM(n). The first electrode of the fourth switch transistor T4 is connected to the third node n3, and the second electrode of the fourth switch transistor T4 is connected to the fourth node n4.

The light-emission signal EM(n) controls on/off operation of the third and the fourth switch transistor T3 and T4 so that the flow of the current in the light-emitting element (OLED) is switched, thereby controlling a turn-on and a turn-off time for the light-emitting element (OLED).

The fifth switch transistor T5 is turned on in response to the gate-on voltage VGL of the (n−1)-th scan signal SCAN (n−1) and connects the second node n2 to the initialization voltage line 103. A gate electrode of the fifth switch transistor T5 is connected to the first gate line GL_1 through which the scan signal for controlling supply of the data voltage to the pixels in the (n−1)-th horizontal line is supplied, and thus receives the (n−1)-th scan signal SCAN (n−1). A first electrode of the fifth switch transistor T5 is connected to the second node n2, and a second electrode of the fifth switch transistor T5 is connected to the initialization voltage line 103.

The sixth switch transistor T6 is turned on in response to the gate-on voltage VGL of the (n−1)-th scan signal SCAN (n−1) and connects the initialization voltage line 103 to the fourth node n4. A gate electrode of the sixth switch transistor T6 is connected to the first gate line GL_1 for the (n−1)-th horizontal line and thus receives the (n−1)-th scan signal SCAN(n−1). A first electrode of the sixth switch transistor T6 is connected to the initialization voltage line 103, and the second electrode of the sixth switch transistor T6 is connected to the fourth node n4.

The driving element DT drives the light-emitting element (OLED) by controlling the current flowing to the light-emitting element (OLED) according to the gate-source voltage Vgs. The driving element DT includes the gate electrode connected to the second node n2, the first electrode connected to the first node nl, and the second electrode connected to the third node n3.

During the initialization period t1, the (n−1)-th scan signal SCAN(n−1) is input with the gate-on voltage VGL. The n-th scan signal SCAN(n) and the light-emission signal EM(n) maintain the gate-off voltage VGH during the initialization period t1. Therefore, during the initialization period t1, the fifth and the sixth switch transistor T5 and T6 are turned on, and the second and the fourth node n2 and n4 are initialized with the initialization voltage Vini. The hold period t2 may be set between the initialization period t1 and the sampling period t3. During the hold period t2, the voltage of the (n−1)-th scan signal SCAN(n−1) is changed from the gate-on voltage VGL to the gate-off voltage VGH, and the n-th scan signal SCAN(n) and the light-emission signal EM(n) maintains their previous states.

During the sampling period t3, the n-th scan signal SCAN(n) is input with the gate-on voltage VGL. The pulse of the n-th scan signal SCAN(n) is synchronized with the data voltage Vdata to be supplied to an n-th pixel line. The (n−1)-th scan signal SCAN(n−1) and the light-emission signal EM(n) maintains the gate-off voltage VGH during the sampling period t3. Therefore, during the sampling period t3, the first and the second switch transistor T1 and T2 are turned on.

During the sampling period t3, the voltage of the gate terminal of the driving element DT, namely, the second node n2 is increased by the current flowing through the first and the second switch transistor T1 and T2. When the driving element DT is turned off, a voltage Vn2 of the second node n2 is Vdata-|Vth|. Herein, also the voltage of the first node n1 is Vdata-|Vth|. During the sampling period t3, the gate-source voltage Vgs of the driving element DT is |Vgs|=Vdata−(Vdata−|Vth|)=|Vth|.

During the data writing period t4, the n-th scan signal SCAN(n) is inverted to the gate-off voltage VGH. The (n−1)-th scan signal SCAN(n−1) and the light-emission signal EM(n) maintain the gate-off voltage VGH during the data writing period t4. Therefore, during the data writing period t4, all the switch transistors T1 to T6 maintain an off state.

During the light-emission period t5, the light-emission signal EM(n) keeps maintaining the gate-on voltage VGL or is turned on/off at the predetermined duty ratio, and thus swings between the gate-on voltage VGL and the gate-off voltage VGH. During the light-emission period t5, the (n−1)-th and the n-th scan signal SCAN(n−1) and SCAN(n) maintain the gate-off voltage VGH. During the light-emission period t5, the third and the fourth switch transistor T3 and T4 may repeat on/off operation according to the voltage of the light-emission signal EM. When the voltage of the light-emission signal EM(n) is the gate-on voltage VGL, the third and the fourth switch transistor T3 and T4 are turned on and the current flows to the light-emitting element (OLED). Herein, the gate-source voltage Vgs of the driving element DT is |Vgs|=Vdd−(Vdata−|Vth|), and the current flowing to the light-emitting element (OLED) is $K(Vdd-Vdata)^2$. K is a proportional constant that is determined by carrier mobility of the driving element DT, parasitic capacitance, channel capacity, and the like.

The luminance of light emitted by a light-emitting element (OLED) is proportional to the current flowing in the light-emitting element. The pixel driving voltages Vdd supplied through the first power line 101 vary according to a load or a pattern of an input image. However, when the data voltage Vdata being input is maintained, luminance of light emitted by the light-emitting element (OLED) vary according to the pixel driving voltage Vdd for the same data voltage Vdata.

With reference to FIGS. 6 and 7, the example in which the display panel 10 is composed of pixels including OLED elements has been described, but the display panel 10 may be a liquid crystal display panel.

Figure 8A:
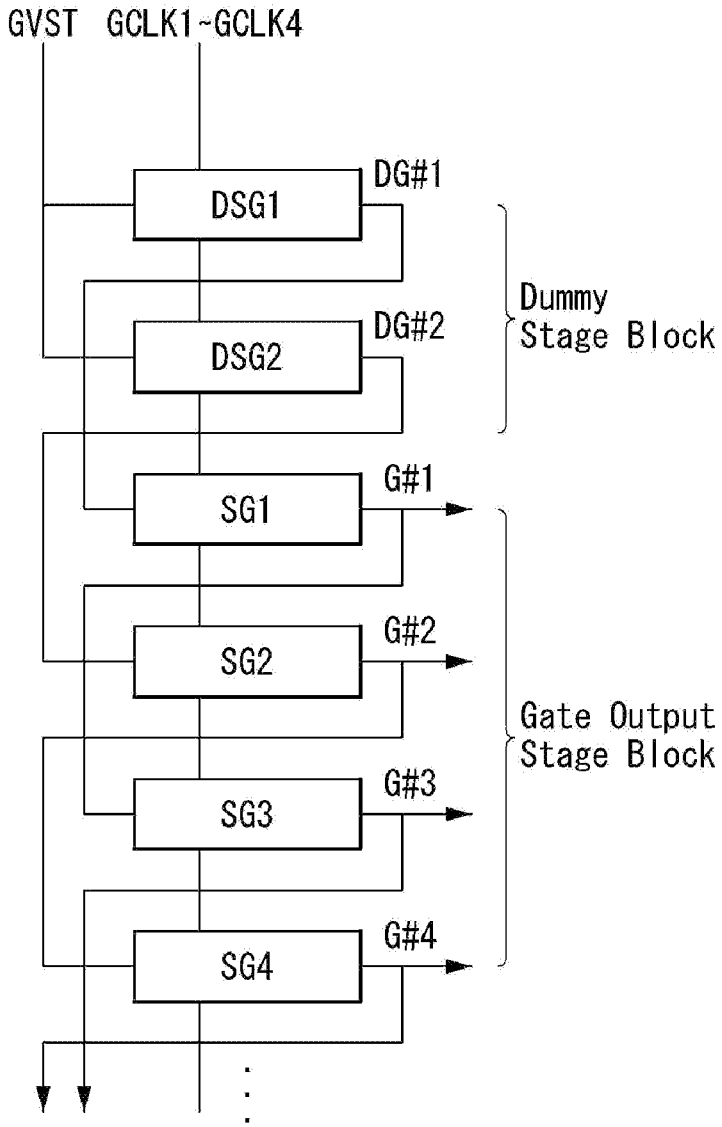
FIG. 8A and 8B are diagrams showing gate driving circuits in which a dummy stage block is placed at an upper side and a lower side of a display panel, respectively according to one embodiment.
Figure 8B:
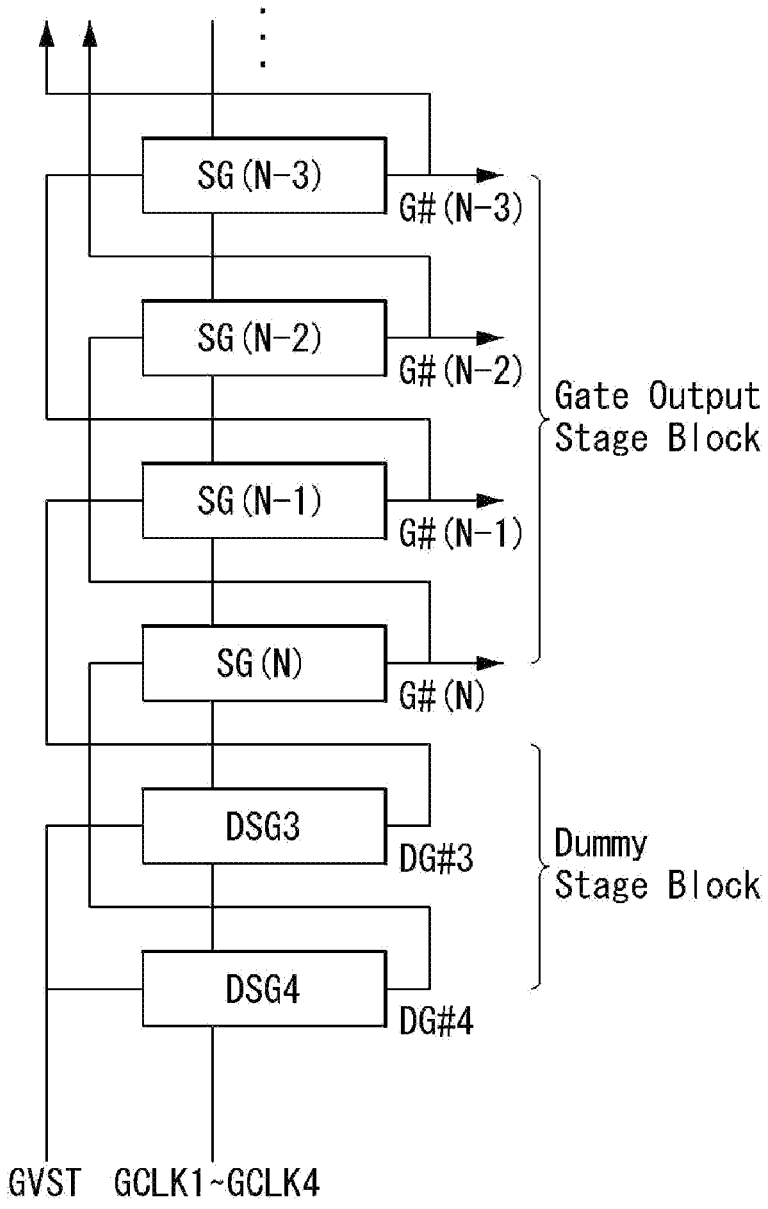

FIG. 8A and 8B are diagrams showing gate driving circuits in which a dummy stage block is placed at the upper side and the lower side of a display panel, respectively. FIG.

9 is a diagram showing the sequence of supplied clocks, a dummy output signal, and a gate output signal in the case of forward driving at 4×n resolution with a 4-phase gate clock in FIG. 3A.

Figure 9:
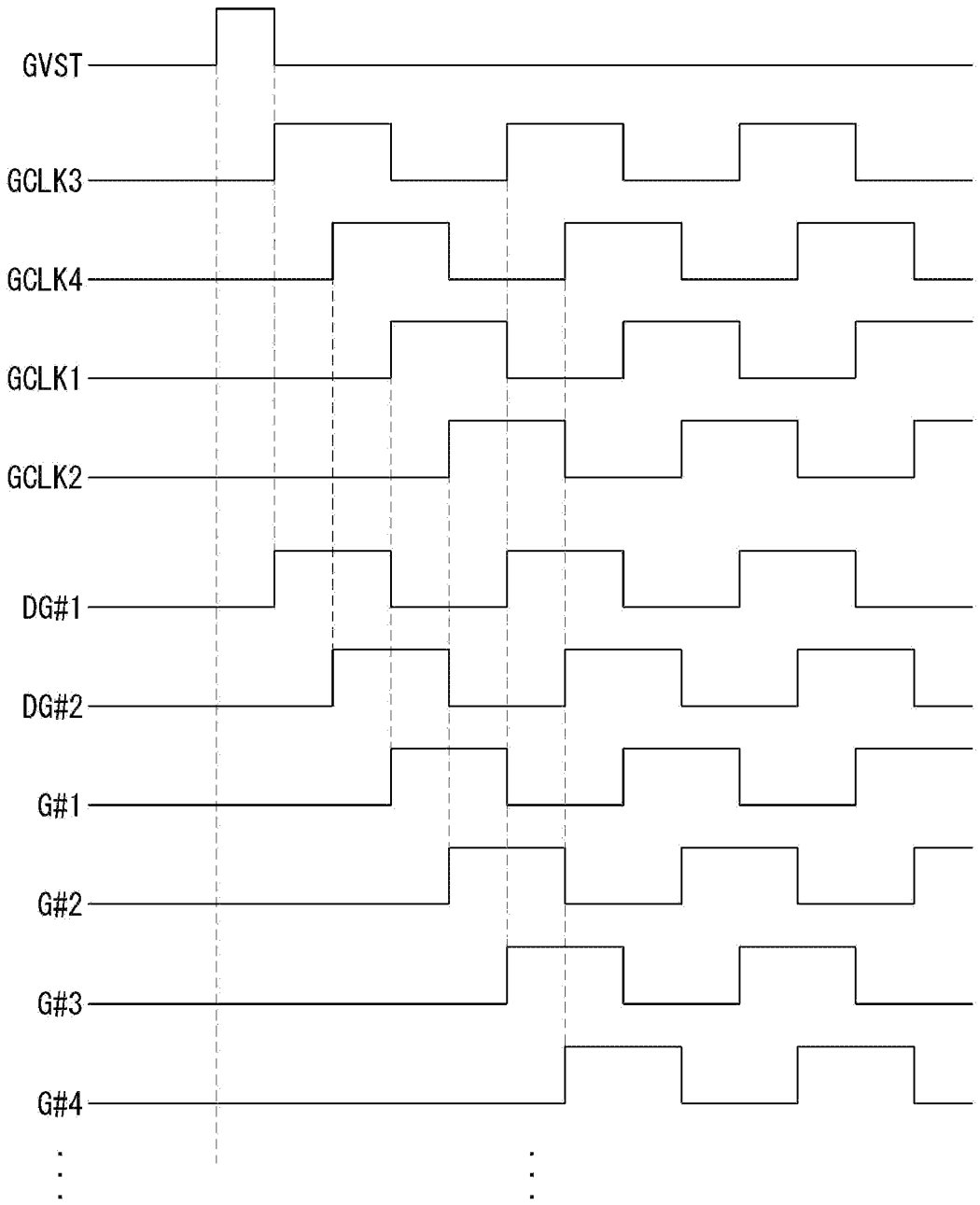
FIG. 9 is a diagram showing the sequence of supplied clocks, a dummy output signal, and a gate output signal in the case of forward driving at 4×n resolution with a 4-phase gate clock in FIG. 3A according to one embodiment.

FIGS. 8A and 8B correspond to a configuration of a shift register for forward driving FWD and reverse driving REV of the display panel 10 using a gate clock having four different phases in FIG. 3A, respectively. In addition, FIG. 9 shows timing of signals that the shift register of FIG. 8A receives and outputs.

The shift register 14 of the gate driving circuit may include multiple gate output stages connected in a dependent manner, and may generate gate signals sequentially.

In FIG. 8A, the shift register 14 may include dummy stages DSG1 and DSG2 in front of a first gate stage SG1 in order to output the gate signals stably.

The front dummy stages DSG1 and DSG2 are set simultaneously in response to a pulse of the gate start signal GVST applied from outside, and output a first and a second dummy gate signal DG#1 and DG#2 having phases that result from sequential delay in synchronization with the gate clocks GCLK1 to GCLK4.

As described above with reference to FIG. 3A, in the case of forward driving at 4×n resolution with 4-phase gate clocks GCLK1 to GCLK4, start dummy clocks are a 3-phase clock and a 4-phase clock. Therefore, as shown in FIG. 9 for describing forward driving, after the pulse of the gate start signal GVST, gate clocks GCLK3, GCLK4, GCLK1, and GCLK2 are input in that order, and the first and the second dummy stage DSG1 and DSG2 output the first and the second dummy gate signal DG#1 and DG#2 in synchronization with the dummy start clocks GCLK3 and GCLK4, respectively.

A first and a second gate stage SG1 and SG2 are set sequentially in response to the first and the second dummy gate signal DG#1 and DG#2, which are generated in synchronization with the third and the fourth gate clock GCLK3 and GCLK4, respectively, and output a first and a second gate signal G#1 and G#2 having phases that result from sequential delay in synchronization with the first and the second gate clock GCLK1 and GCLK2, respectively.

Similarly, a third and a fourth gate stage SG3 and SG4 are set sequentially in response to the first and the second gate signal G#1 and G#2, respectively, and output a third and a fourth gate signal G#3 and G#4 having phases that result from sequential delay in synchronization with the third and the fourth gate clock GCLK3 and GCLK4, respectively.

In FIG. 8B corresponding to the configuration for reverse driving, the shift register 14 may include dummy stages DSG3 and DSG4 behind an N-th gate stage SGN, which is the last gate stage, in order to output gate signals stably. The rear dummy stages DSG4 and DSG3 are set simultaneously in response to a pulse of the gate start signal GVST applied from outside, and output a fourth and a third dummy gate signal DG#4 and DG#3 having phases that result from sequential delay in synchronization with the gate clocks GCLK1 to GCLK4.

Similarly to the above description with reference to FIG. 8A, an N-th to an (N−3)-th gate stage SGN to SG(N−3) output gate signals in response to the dummy gate signals output from the rear dummy stages DSG4 and DSG3 or the gate signals output from the rear gate stages.

In the case of forward driving, among dummy registers of the shift register 14, the gate start signal GVST is connected to the first and the second dummy stage DSG1 and DSG2 placed in front of the first gate stage SG1 that corresponds to the first pixel line of the display panel. In contrast, in the case of reverse driving, the gate start signal GVST is connected to the third and the fourth dummy stage DSG3 and DSG4 placed behind the N-th gate stage SG(N) corresponding to the last pixel line of the display panel.

Accordingly, the level shifter 13 may differentiate the connection of the gate start signal GVST, distinguishing between forward driving and reverse driving. In the case of forward driving, the gate start signal GVST is supplied to the first and the second dummy stage DSG1 and DSG2 that are placed in front of the first gate stage SG1. In the case of reverse driving, the gate start signal GVST is supplied to the third and the fourth dummy stage DSG3 and DSG4 that are placed behind the N-th gate stage SG(N).

Figure 10:
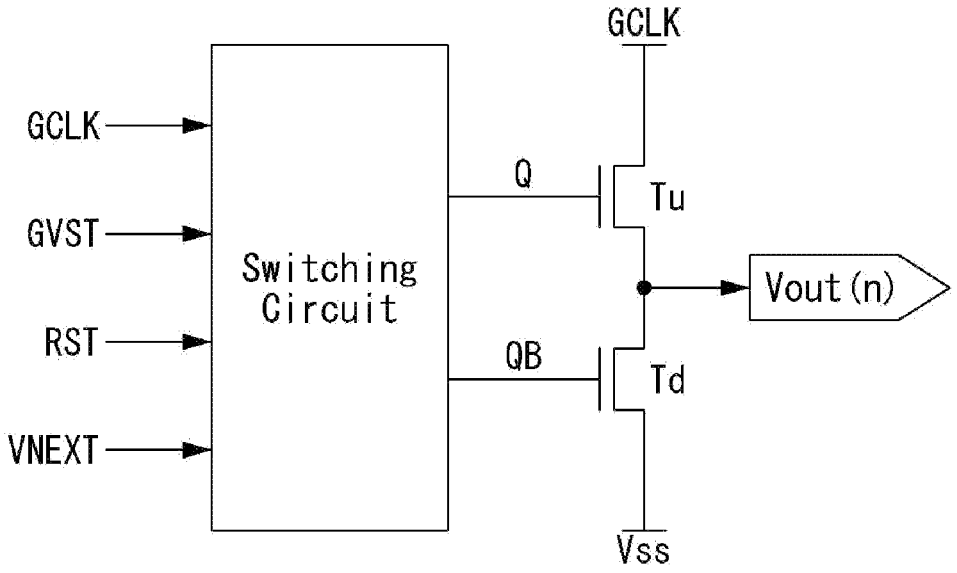
FIG. 10 is a diagram showing schematically a configuration of a gate stage outputting a gate pulse in a GIP circuit according to one embodiment.

FIG. 10 is a diagram showing schematically a configuration of a gate stage outputting a gate pulse in a GIP circuit.

Each of the gate stages of FIGS. 8A and 8B includes a pull-up transistor Tu, a pull-down transistor Td, and a switching circuit. The pull-up transistor Tu increases an output voltage by charging an output terminal in response to a Q node voltage. The pull-down transistor Td decreases an output voltage by discharging the output terminal in response to a QB node voltage. The switching circuit charges and discharges a Q node and a QB node. The output terminal is connected to the gate line GL of the display panel 100, so that an output voltage Vout(n) is applied to the gate line GL.

The pull-up transistor Tu charges the output terminal with up to the gate high voltage VGH of the gate clock GCLK, when the gate clock GCLK is input to the drain while the Q node is pre-charged by the gate high voltage VGH. When the gate clock GCLK is input to the drain of the pull-up transistor Tu, the voltage of the Q node subjected to floating through parasitic capacitance between the drain and the gate of the pull-up transistor Tu is increased to the voltage higher than the gate high voltage VGH due to bootstrapping and may reach about 2 VGH. Herein, the pull-up transistor Tu is turned on by the voltage of the Q node, so that the voltage of the output terminal increases up to the gate high voltage VGH.

The pull-down transistor Td decreases the output voltage Vout(n) to the gate low voltage VGL by supplying the gate low voltage VGL to the output terminal when the QB voltage reaches the gate high voltage VGH.

The switching circuit charges the Q node in response to the gate start signal GVST input through a GVST terminal or a carry signal received from the previous gate stage, and discharges the Q node in response to a signal received through an RST terminal or a VNEXT terminal To the RST terminal, a reset signal for discharging the Q nodes of all the gates stages simultaneously is applied. To the VNEXT terminal, a carry signal generated from the subsequent stage is input. The switching circuit may charge and discharge the QB node in a reverse manner to the Q node by using an inverter.

The switching circuit is capable of bi-directional scanning. In the case of performing reverse driving, the switching circuit receives the carry signal from the previous gate stage through the GVST terminal, and in response to this, charges the Q node. The switching circuit receives the carry signal from the subsequent gate stage through the VNEXT terminal, and in response to this, discharges the Q node.

Figure 11A:
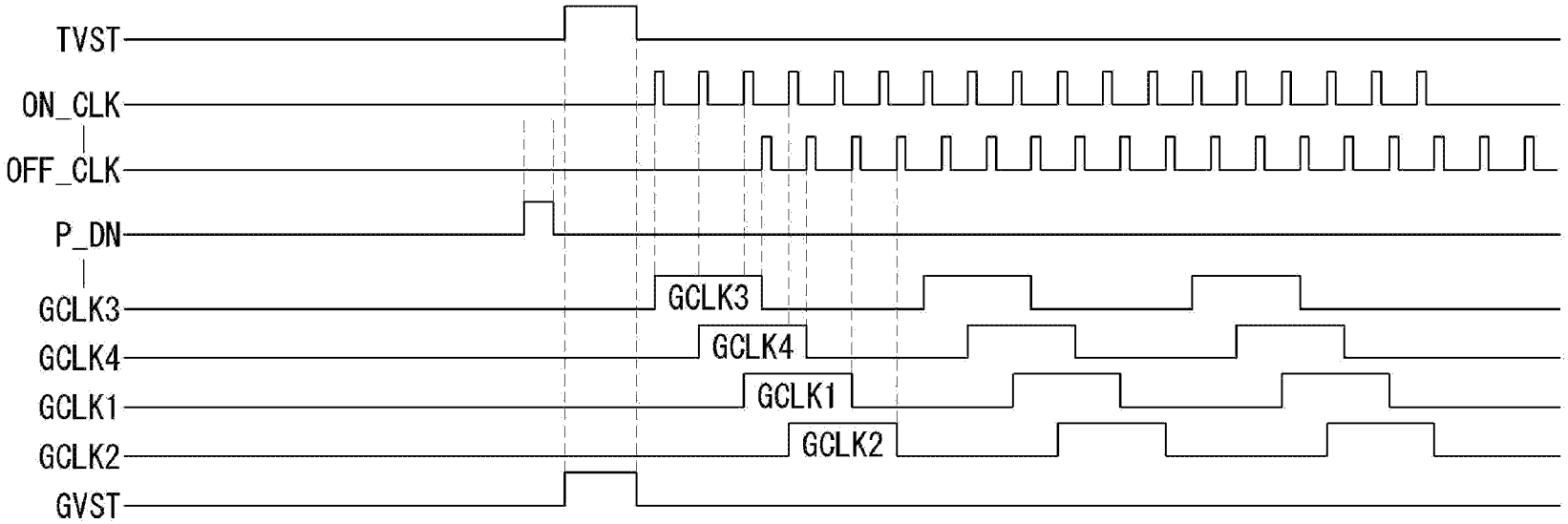
FIGS. 11A and 11B are diagrams showing a signal transmitted by a timing controller and a clock generated by a level shifter accordingly when a 4-phase clock is used in forward driving and reverse driving, respectively according to one embodiment.
Figure 11B:
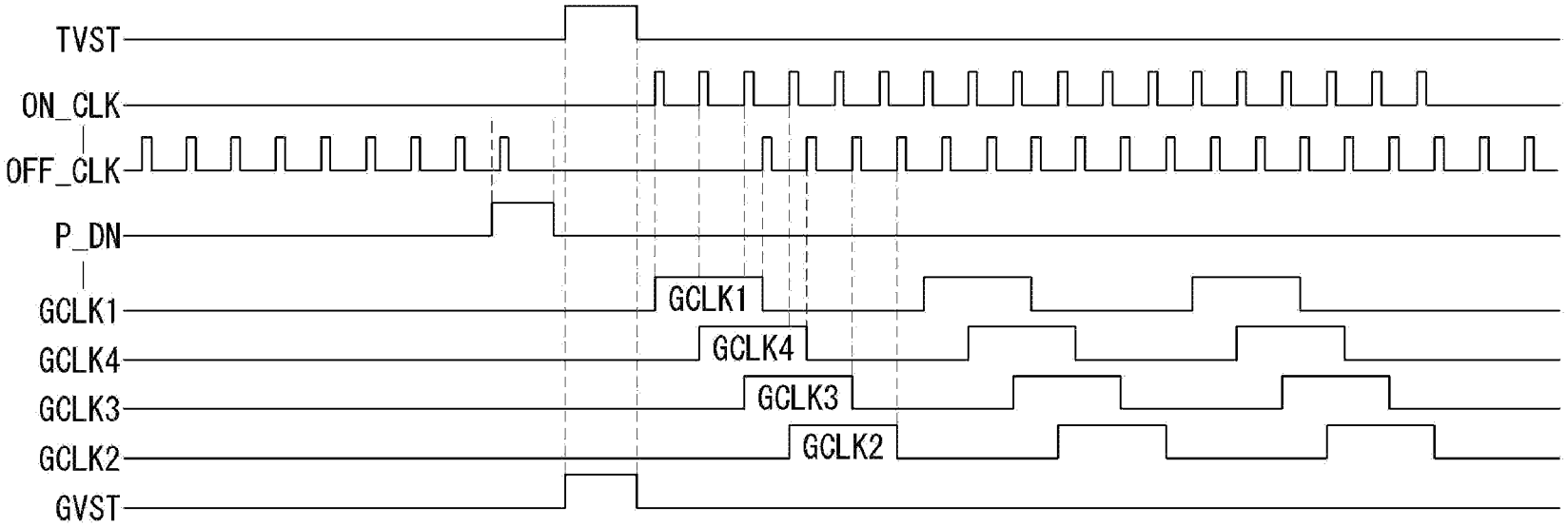

FIGS. 11A and 11B are diagrams showing a signal transmitted by the timing controller and a clock generated by the level shifter accordingly when a 4-phase clock is used in forward driving and reverse driving, respectively.

The timing controller 11 generates a timing start signal TVST, an on clock ON_CLK, an off clock OFF_CLK, and a control signal P_DN for the level shifter 13, and transmits the same to the level shifter 13.

The on clock ON_CLK and the off clock OFF_CLK are generated after a pulse of the timing start signal TVST informing about the start of a frame. A pulse of the control signal P_DN is generated in the vertical blank period before the pulse of the timing start signal TVST.

The timing controller 11 may not generate the off clock OFF_CLK during the vertical blank period as shown in FIG. 11A in order to inform about forward driving of the display panel 10. Therefore, there is no pulse of the off clock OFF_CLK in the pulse section of the control signal P_DN that is generated in the vertical blank period before the pulse of the timing start signal TVST. In this case, the timing controller 11 may generate the pulse of the control signal P_DN at any time in the vertical blank period, without temporal limitation to the pulse section of the control signal P_DN.

The level shifter 13 detects the pulse of the control signal P_DN in the vertical blank period and counts the pulses of the off clock OFF_CLK during the corresponding pulse period. Since there is no pulse of the off clock OFF_CLK during the pulse period of the control signal P_DN, it is determined that forward driving takes place.

Accordingly, the level shifter 13 generates the pulse of the gate start signal GVST in synchronization with the pulse of the timing start signal TVST, generates gate clocks in sequence, 3-4-1-2, specifically, GCLK3->GCLK4->GCLK1->GCLK2 in that order (see the start dummy clocks of forward driving using the 4-phase clock in FIG. 3A) by using the on clock ON_CLK and the off clock OFF_CLK after the pulse of the timing start signal TVST, and transmits the resulting gate clocks and the gate start signal GVST together to the shift register 14. The sequence of the gate clocks for forward driving may be different from that of FIG. 3A, and may be 1->2->3->4.

Differently from FIG. 11A, the timing controller 11 may generate and output the off clock OFF_CLK even in the vertical blank period. Herein, the timing controller 11 may generate pulses of the off clock OFF_CLK only until the time a predetermined time ahead of a rising edge of the timing start signal TVST informing about the start of a frame, and may generate a pulse of the control signal P_DN after the last pulse of the off clock OFF_CLK and before the rising edge of the timing start signal TVST.

Then, there is no pulse of the off clock OFF_CLK in the pulse period of the control signal P_DN, so that the level shifter 13 may determine that a forward driving takes place.

In FIG. 11B, the timing controller 11 does not generate the pulse of the on clock ON_CLK in the vertical blank period, but generates the pulses of the off clock OFF_CLK until the time a predetermined time ahead of a rising edge of the timing start signal TVST.

In addition, the timing controller 11 generates the pulse of the control signal P_DN before the rising edge of the timing start signal TVST. Herein, the timing controller 11 may adjust the width of the pulse of the control signal P_DN so that the phase of the start clock among the gate clocks GCLKs to be transmitted by the level shifter 13 to the shift register 14 is determined.

For example, when the start gate clock is 1, one pulse of the off clock OFF_CLK is caused to be included in the pulse period of the control signal P_DN. When the start gate clock is 2, two pulses of the off clock OFF_CLK are caused to be included in the pulse period of the control signal P_DN. That is, the number of pulses of the off clock OFF_CLK included in the pulse period of the control signal P_DN may correspond to the start clock among the gate clocks to be transmitted by the level shifter 13 to the shift register 14.

In FIG. 11B, one pulse of the off clock OFF_CLK is included in the pulse period of the control signal P_DN. Therefore, the level shifter 13 generates phase 1 first as the start clock among the gate clocks GCLKs, then generates gate clocks in reverse order 4->3->2, and transmits the resulting clocks to the shift register 14. Referring to FIG. 3A, the case in which the sequence of gate clocks is 1->4>3->2 corresponds to the case of reverse driving at (4×n+3) resolution with a 4-phase gate clock.

Figure 12A:
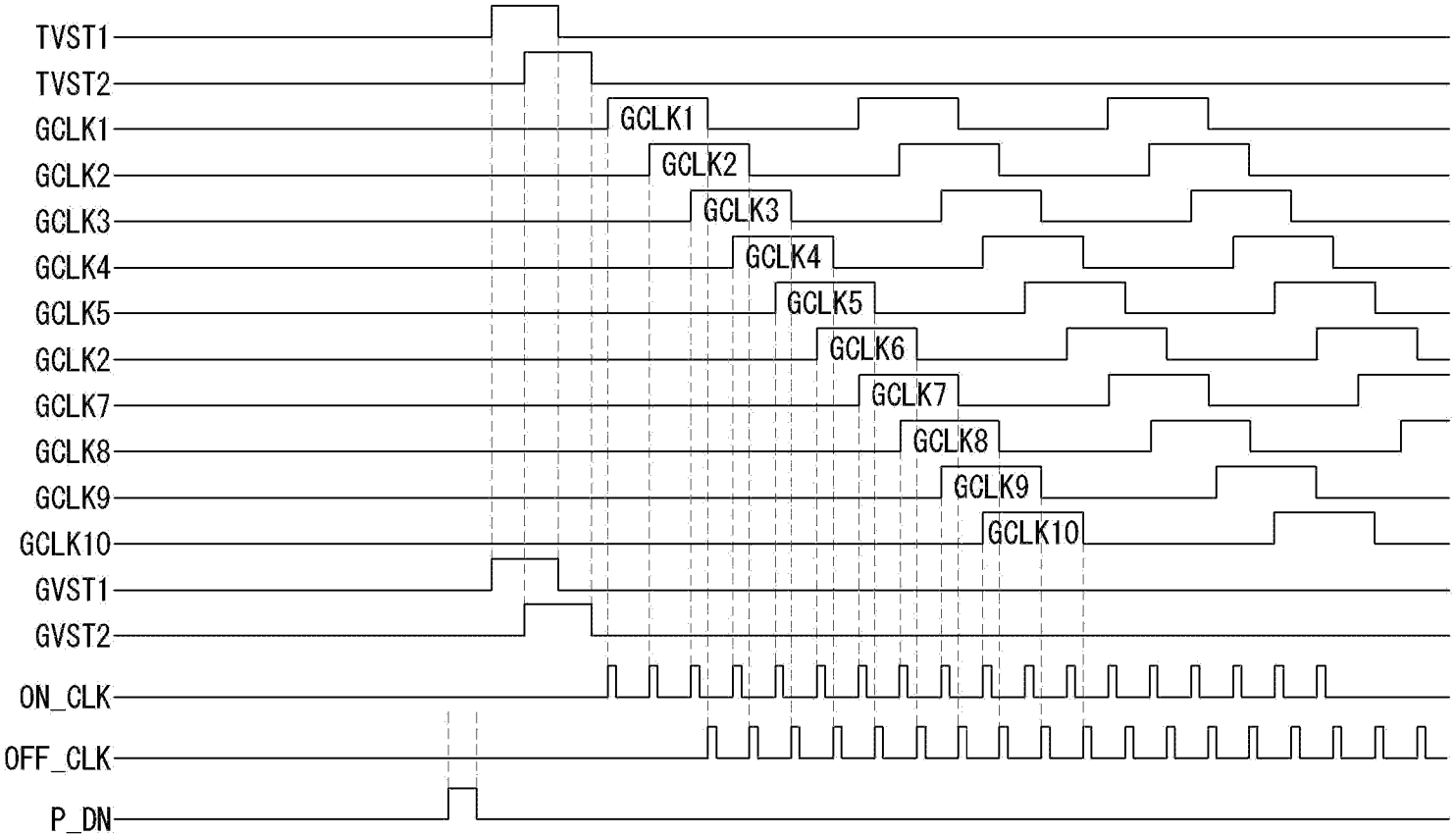
FIG. 12A is a diagram showing a signal transmitted by a timing controller and a clock generated by a level shifter accordingly with respect to forward driving in the case of using a 10-phase clock according to one embodiment.
Figure 12B:
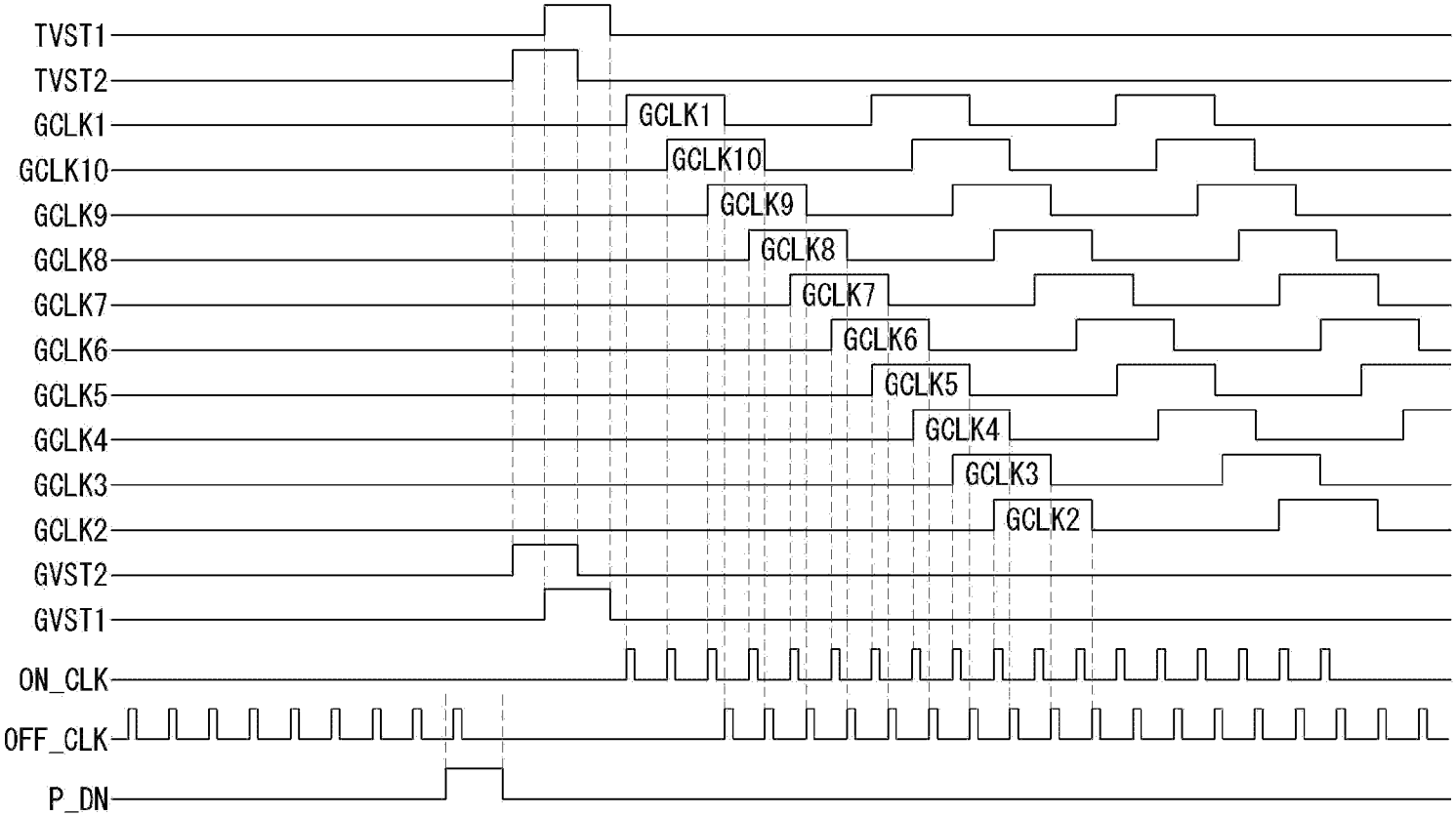
FIGS. 12B and 12C are diagrams each showing a signal transmitted by a timing controller and a clock generated by a level shifter accordingly with respect to reverse driving in the case of using a 10-phase clock according to one embodiment.
Figure 12C:
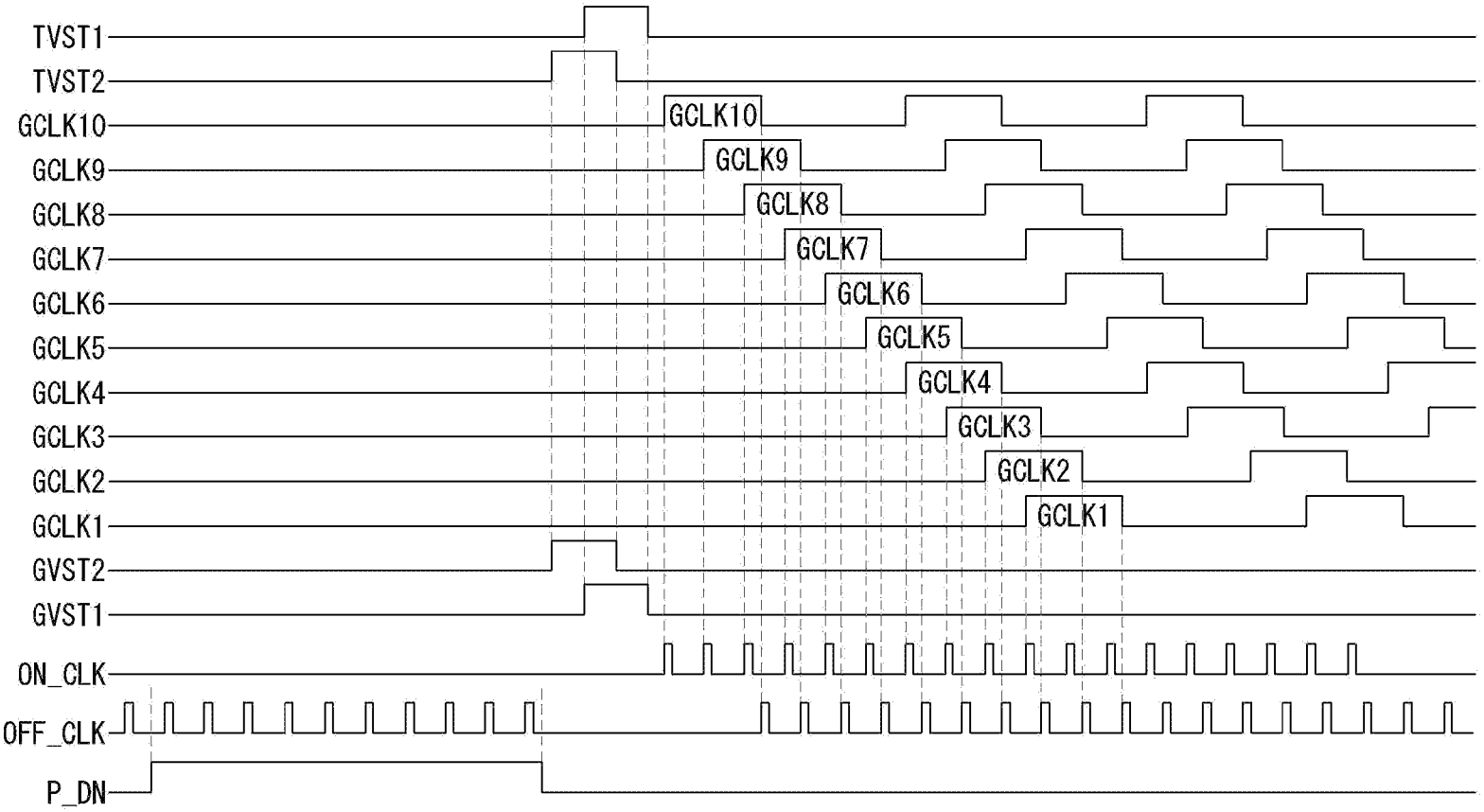

FIG. 12A is a diagram showing a signal transmitted by a timing controller and a clock generated by a level shifter accordingly with respect to forward driving in the case of using a 10-phase clock. FIGS. 12B and 12C are diagrams each showing a signal transmitted by a timing controller and a clock generated by a level shifter accordingly with respect to reverse driving in the case of using a 10-phase clock.

In the case of using a 10-phase clock, the timing controller 11 generates two timing start signals TVST1 and TVST2 and transmits the same to the level shifter 13. Herein, in order to distinguish between forward driving and reverse driving, in the case of forward driving, timing start signals TVST1 and TVST2 are generated in that order and output, and in the case of reverse driving, timing start signals TVST2 and TVST1 are generated in that order and output.

In FIG. 12A, the timing controller 11 does not generate a pulse of an off clock OFF_CLK in the vertical blank period, but generates a control signal P_DN in the vertical blank period before a pulse of a timing start signal TVST, so that there is no pulse of the off clock OFF_CLK in the pulse section of the control signal P_DN.

The level shifter 13 detects the pulse of the control signal P_DN in the vertical blank period and counts the pulses of the off clock OFF_CLK during the corresponding pulse period. Since there is no pulse of the off clock OFF_CLK during the pulse period of the control signal P_DN, it is determined that forward driving takes place.

The level shifter 13 generates pulses of gate start signals GVST1 and GVST2 in synchronization with the pulses of the timing start signals TVST1 and TVST2, generates gate clock GCLKs in sequence, phase 1 to phase 10 by using the on clock ON_CLK and the off clock OFF_CLK after the pulse of the second timing start signal TVST2, and transmits the resulting gate clocks and the gate start signals GVST1 and GVST2 together to the shift register 14.

In FIG. 12B, the timing controller 11 generates the timing start signals TVST2 and TVST1 in that order, and generates a pulse of an off clock OFF_CLK without generating a pulse of an on clock ON_CLK in the vertical blank period. In addition, the timing controller 11 generates a pulse of a control signal P_DN before the rising edge of the timing start signal TVST2. Herein, the timing controller 11 may adjust the width of the pulse of the control signal P_DN so that the phase of the start clock among the gate clocks GCLKs to be transmitted by the level shifter 13 to the shift register 14 is determined.

In FIG. 12B, there is one pulse of the off clock OFF_CLK in the pulse period of the control signal P_DN. Therefore, the level shifter 13 generates phase 1 first as the start clock among the gate clocks GCLKs, then generates gate clocks in reverse order starting from phase 10 to phase 2, and transmits the resulting clocks to the shift register 14.

Similarly, in FIG. 12C, there are 10 pulses of the off clock OFF_CLK in the pulse period of the control signal P_DN. Therefore, the level shifter 13 generates phase 10 first as the start clock among the gate clocks GCLKs, then generates gate clocks in reverse order starting from phase 9 to phase 1, and transmits the resulting clocks to the shift register 14.

Figure 13:
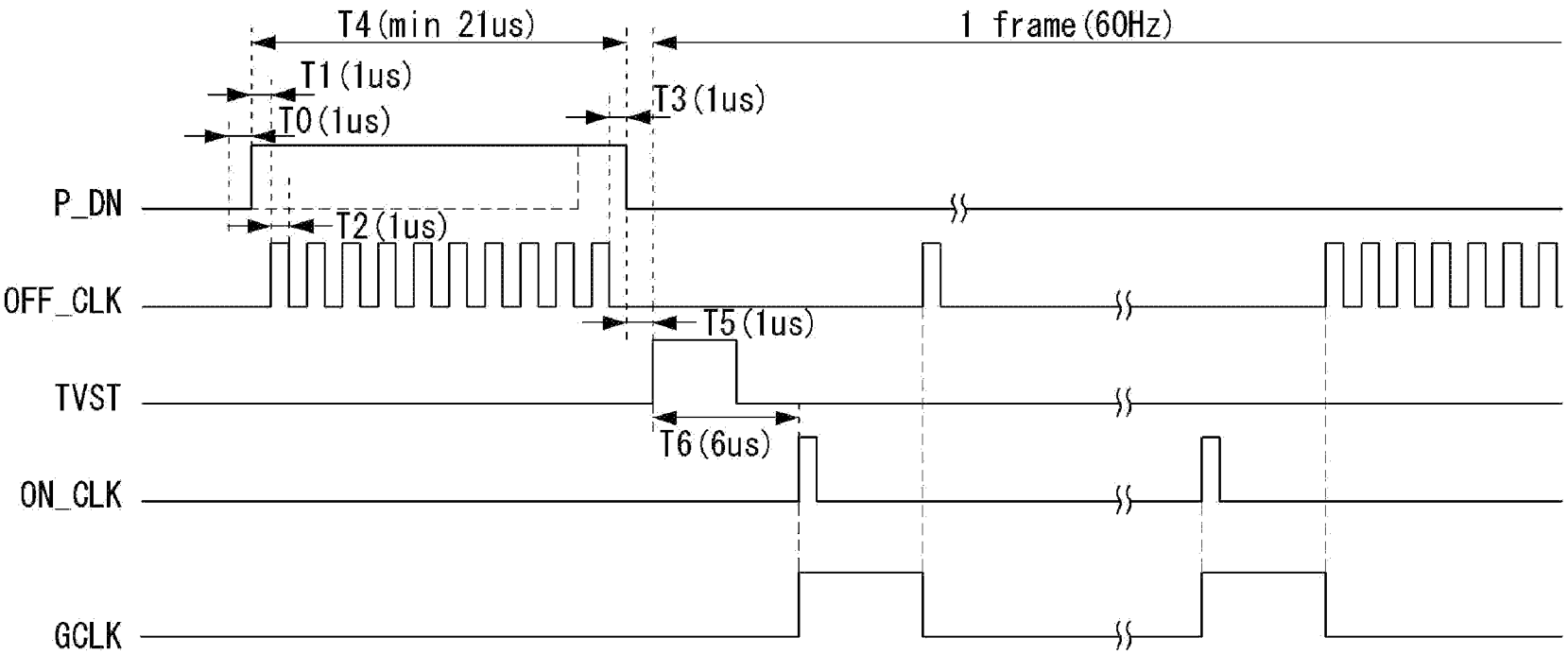
FIG. 13 is a diagram showing timing of an on clock, an off clock, a control signal, and a start signal according to one embodiment.

FIG. 13 is a diagram showing timing of an on clock, an off clock, a control signal, and a start signal.

In the case of using a 10-phase clock GCLK1 to GCLK10, when the timing controller 11 informs the level shifter 13 about reverse driving in which a phase 10 clock is used as a start clock, 10 pulses of the off clock OFF_CLK need to be included in the pulse period of the control signal P_DN.

In order for the level shifter 13 to accurately identify reverse driving and the start clock, the timing controller 11 may make the intervals between the pulses of the off clock OFF_CLK in the vertical blank period longer than in the vertical active period.

In addition, in order for the level shifter 13 to accurately distinguish between the edge of the control signal P_DN and the pulse edge of the off clock OFF_CLK, the timing controller 11 may space the edges at an interval of a predetermined time t0 or more.

In the vertical blank period, the interval between the rising edge of the control signal P_DN and the first pulse of the off clock OFF_CLK may set to be the predetermined time t0. The width of the pulse of the off clock OFF_CLK may set to be the predetermined time t0. The period of the off clock OFF_CLK may set to twice the predetermined time (2×t0). The interval between the falling edge of the control signal P_DN and the falling edge of the last pulse of the off clock OFF_CLK is set to be the predetermined time t0.

In FIG. 13, in the vertical blank period, in the case where the interval (T1) between the rising edge of the control signal P_DN and the rising edge of the first pulse of the off clock OFF_CLK is set to be 1 us, where the width (T2) of the pulse is set to be 1 us, the period of the off clock OFF_CLK is set to be 2 us, and where the interval (T3) between the falling edge of the control signal P_DN and the falling edge of the last pulse of the off clock OFF_CLK is set to be 1 us, that is, in the case where the predetermined time t0 is 1 us, the width of the pulse of the control signal P_DN may be at least 21 us (T4).

In addition, the interval (T0) between start timing of the vertical blank period and the rising edge of the control signal P_DN is set to be the predetermined time t0, for example, 1 us or more. The interval (T5) between the falling edge of the control signal P_DN and the rising edge of the timing start signal TVST informing about the start of the vertical active period is set to be the predetermined time t0, for example, 1 us or more. In the vertical active period, the interval (T6) between the rising edge of the timing start signal TVST and the rising edge of the on clock ON_CLK is set to be several times as long as 1 us, which is the predetermined time t0, for example, 6 us.

The timing controller 11 may generate the control signal P_DN, fixing the width of the pulse corresponding to the maximum number of phases of the gate clocks GCLKs to be generated through the level shifter 13. The timing controller 11 may generate pulses of the off clock OFF_CLK as many as corresponding to start pulse to be generated through the level shifter 13, in the pulse period of the control signal P_DN.

Alternatively, the timing controller 11 may generate a variable width of the pulse of the control signal P_DN so that the width covers the pulses of the off clock OFF_CLK in number corresponding to the start pulse to be generated through the level shifter 13. In this case, the falling edge of the control signal P_DN is fixed to the timing 1 us ahead of the rising edge of the timing start signal TVST informing about the subsequent vertical active period. The rising edge of the control signal P_DN may vary due to the number of pulses of the off clock OFF_CLK corresponding to the start pulse.

Figure 14:
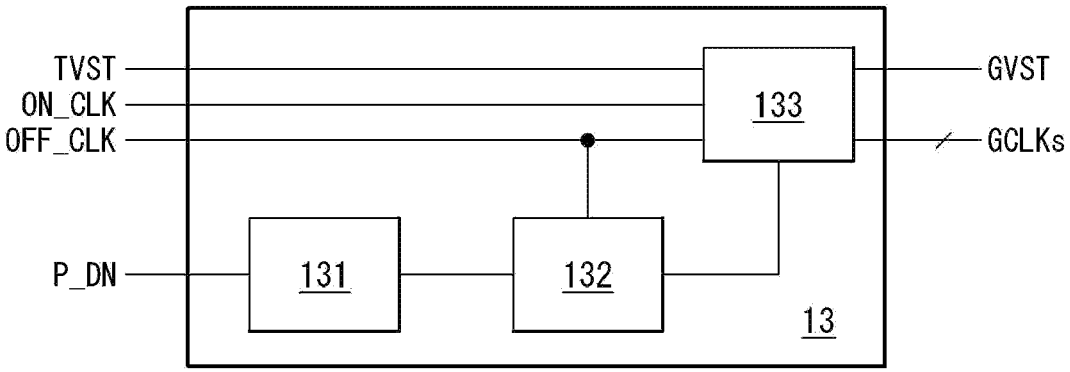
FIG. 14 is a diagram showing a configuration of a level shifter that generates a clock by using signals transmitted from a timing controller according to one embodiment.

FIG. 14 is a diagram showing a configuration of a level shifter that generates a clock by using signals transmitted from a timing controller.

A level shifter 13 may include a control signal detector 131, a counter 132, and a clock generator 133.

The control signal detector 131 detects the rising edge of the control signal P_DN.

The counter 132 counts pulses of the off clock OFF_CLK in synchronization with detection of the rising edge by the control signal detector 131.

The clock generator 133 generates the gate start signal GVST in synchronization with the timing start signal TVST, and generates the gate clocks GCLKs by using the on clock ON_CLK and the off clock OFF_CLK. Herein, the clock generator 133 generates the gate clock GCLKs, starting from the start clock determined on the basis of the output of the counter 132.

When the counter 132 outputs a value of 0 as a result of count, the clock generator 133 generates gate clocks GCLKs in the order corresponding to forward driving. For example, the clock generator 133 may generates gate clocks GCLKs in ascending order, starting from clock 1, and may output the same.

When the counter 132 outputs a value of a non-zero natural number as a result of count, the clock generator 133 generates gate clocks GCLKs in reverse order, starting from the natural number. For example, in the case of generating a 10-phase gate clock, when the counter 132 outputs a value of 4, the clock generator 133 generates gate clock GCLKs 4->3->2->1->10->9->8->7->6->5 in that order and outputs the same.

The level shifter 13 supplies the generated gate start signal GVST and gate clocks GCLKs to the shift register 14 so that each gate stage of the shift register 14 outputs a scan signal and a light-emission signal to the corresponding gate line.

In the meantime, without using the control signal P_DN, the timing controller 11 may transmit information on forward/reverse driving direction and start clock (or the sequence of gate clocks) to the level shifter 13, by using the number of pulses of the off clock OFF_CLK (or on clock ON_CLK) included in the vertical blank period.

In this case, the level shifter 13 may identify the start timing of the vertical blank period by counting the base clock from the rising edge of the timing start signal TVST, and may determine the scan direction and the start clock by counting the pulses of the off clock OFF_CLK from the start of the vertical blank period to the rising edge of the timing start signal TVST of the subsequent frame.

Alternatively, the level shifter 13 may determine the timing at which a pulse of the on clock ON_CLK is not output for a predetermined time or longer, as the start of the vertical blank period, and from this time to the rising edge of the timing start signal TVST of the subsequent frame, the level shifter 13 may count pulses of the off clock OFF_CLK, thereby determining the scan direction and the start clock.

Alternatively, the timing controller 11 does not output an off clock OFF_CLK during the vertical blank period, but outputs an on clock ON_CLK. The level shifter 13 may determine a scan direction and a start clock on the basis of the number of pulses of the on clock ON_CLK counted during the vertical blank period.

The timing controller 11 may generate the off clock OFF_CLK (or on clock ON_CLK) with the same clock period in the vertical blank period as in the vertical active period. Alternatively, in order for the level shifter 13 to accurately determine the scan direction and the start clock, the timing controller 11 may generate the off clock OFF_CLK (or on clock ON_CLK) with the longer clock period in the vertical blank period than in the vertical active period.

As described above, while employing a simple interface that transmits only the on clock, the off clock, the start signal, and the control signal without directly transmitting a clock signal between the timing controller and the level shifter, information on whether reverse driving takes place and information on the start clock in the case of reverse driving are accurately transmitted. In addition, by reducing the number of wires between the timing controller and the level shifter, a panel driving chip or a PCB is reduced in size and the bezel is reduced accordingly.

The display device in this specification may be described as follows.

According to an embodiment, there is provided a display device including: a display panel; a timing controller supplying image data of an input image, and generating and outputting a first start signal, an on clock, and an off clock; a level shifter generating a second start signal in synchronization with the first start signal, generating gate clocks that swing to a predetermined voltage and have multiple phases, by using the on clock and the off clock, and outputting the generated gate clocks; a shift register including multiple stages connected to gate lines of the display panel, respectively, and outputting a scan signal sequentially to the gate lines by using the second start signal and the gate clocks; and a data driving circuit supplying a data voltage corresponding to the image data to data lines of the display panel in synchronization with the scan signal, wherein the level shifter generates the gate clocks according to order determined on the basis of the number of pulses of the on clock or the off clock included in a vertical blank period.

In an embodiment, the level shifter may generate the gate clocks according to order corresponding to forward driving, when there is no pulse of the on clock or the off clock in the vertical blank period.

In an embodiment, the level shifter may generate, as a start clock among the gate clocks, a clock having a first phase corresponding to the number of the pulses of the on clock or the off clock included in the vertical blank period.

In an embodiment, the level shifter may generate the gate clocks in reverse order by using the clock having the first phase as the start clock.

In an embodiment, the level shifter may use timing at which the pulse of the on clock is not output for a predetermined time or longer, as start timing of the vertical blank period, and may count the number of the pulses of the off clock, from the start timing to a first edge of the first start signal of a subsequent frame.

In an embodiment, the timing controller may output a control signal in a pulse form to the level shifter in the vertical blank period, and the level shifter may determine a start clock among the gate clocks on the basis of the number of the pulses of the on clock or the off clock which are included in a first pulse of the control signal.

In an embodiment, the level shifter may generate the gate clocks according to order corresponding to forward driving, when there is no pulse of the on clock or the off clock within the first pulse.

In an embodiment, the level shifter may generate the gate clocks in reverse order by using, as the start clock, a clock having a first phase corresponding to the number of the pulses of the on clock or the off clock included within the first pulse.

In an embodiment, the level shifter may include: a control signal detector detecting an edge of the control signal; a counter counting the pulses of the on clock or the off clock in synchronization with detecting of the edge by the control signal detector; and a clock generator generating the second start signal in synchronization with the first start signal, and generating the gate clocks in a vertical active period by using the on clock and the off clock, the gate clocks starting from the start clock determined on the basis of an output of the counter.

In an embodiment, the clock generator may generate a first edge of the gate clocks in synchronization with a first edge of the on clock, and may generate a second edge of the gate clocks in synchronization with a first edge of the off clock.

In an embodiment, the level shifter may change a connection path of the second start signal output to the shift register, on the basis of the number of the pulses of the on clock or the off clock included in the vertical blank period.

In an embodiment, the timing controller may generate the on clock or the off clock with a longer clock period in the vertical blank period than in a vertical active period, and may output the on clock or the off clock.

According to another embodiment, there is provided a method of driving a display panel, the method including: generating, at a first step, a first start signal, an on clock, and an off clock; generating, at a second step, a second start signal in synchronization with the first start signal, and generating gate clocks that swing to a predetermined voltage and have multiple phases, by using the on clock and the off clock, wherein the gate clocks are generated according to order determined on the basis of the number of pulses of the on clock or the off clock included in a vertical blank period; and outputting, at a third step, a scan signal sequentially to gate lines of the display panel by using the second start signal and the gate clocks, and supplying a data voltage to data lines of the display panel in synchronization with the scan signal.

In an embodiment, at the first step, a control signal in a pulse form may be further generated in the vertical blank period, and at the second step, a start clock among the gate clocks may be determined on the basis of the number of the pulses of the on clock or the off clock included in a first pulse of the control signal.

In an embodiment, at the second step, the gate clocks may be generated according to order corresponding to forward driving, when there is no pulse of the on clock or the off clock within the first pulse, and the gate clocks may be generated in reverse order by using, as the start clock, a clock having a first phase corresponding to the number of the pulses of the on clock or the off clock included within the first pulse.

Through the above description, those skilled in the art will appreciate that various changes and modifications are possible without departing from the technical idea of the present disclosure. Therefore, the technical scope of the present disclosure is not limited to the contents of the detailed description of the specification, but is determined by the scope of the appended claims.

What is claimed is:

1. A display device comprising:

a display panel;

a timing controller supplied with image data of an input image, and generating and outputting a first start signal, an on clock, and an off clock;

a level shifter generating a second start signal in synchronization with the first start signal, generating gate clocks that swing to a predetermined voltage and have multiple phases, by using the on clock and the off clock, and outputting the generated gate clocks;

a shift register including multiple stages connected to gate lines of the display panel, respectively, and outputting a scan signal sequentially to the gate lines by using the second start signal and the gate clocks; and a data driving circuit supplying a data voltage corresponding to the image data to data lines of the display panel in synchronization with the scan signal, wherein the level shifter generates the gate clocks according to order determined on a basis of a number of pulses of the on clock or the off clock included in a vertical blank period.

2. The display device of claim 1, wherein the level shifter generates the gate clocks according to order corresponding to forward driving, when there is no pulse of the on clock or the off clock in the vertical blank period.

3. The display device of claim 1, wherein the level shifter generates, as a start clock among the gate clocks, a clock having a first phase corresponding to the number of the pulses of the on clock or the off clock included in the vertical blank period.

4. The display device of claim 3, wherein the level shifter generates the gate clocks in reverse order by using the clock having the first phase as the start clock.

5. The display device of claim 1, wherein the level shifter uses timing at which a pulse of the on clock is not output for a predetermined time or longer, as start timing of the vertical blank period, and counts the number of the pulses of the off clock, from the start timing to a first edge of the first start signal of a subsequent frame.

6. The display device of claim 1, wherein the timing controller outputs a control signal in a pulse form to the level shifter in the vertical blank period, and the level shifter determines a start clock among the gate clocks on the basis of the number of the pulses of the on clock or the off clock which are included in a first pulse of the control signal.

7. The display device of claim 6, wherein the level shifter generates the gate clocks according to order corresponding to forward driving, when there is no pulse of the on clock or the off clock within the first pulse.

8. The display device of claim 6, wherein the level shifter generates the gate clocks in reverse order by using, as the start clock, a clock having a first phase corresponding to the number of the pulses of the on clock or the off clock included within the first pulse.

9. The display device of claim 6, wherein the level shifter comprises:

a control signal detector detecting an edge of the control signal;

a counter counting the pulses of the on clock or the off clock in synchronization with detecting of the edge by the control signal detector; and a clock generator generating the second start signal in synchronization with the first start signal, and generating the gate clocks in a vertical active period by using the on clock and the off clock, the gate clocks starting from the start clock determined on the basis of an output of the counter.

10. The display device of claim 9, wherein the clock generator generates a first edge of the gate clocks in synchronization with a first edge of the on clock, and generates a second edge of the gate clocks in synchronization with a first edge of the off clock.

11. The display device of claim 1, wherein the level shifter changes a connection path of the second start signal output to the shift register, on the basis of the number of the pulses of the on clock or the off clock included in the vertical blank period.

12. The display device of claim 1, wherein the timing controller generates the on clock or the off clock with a longer clock period in the vertical blank period than in a vertical active period, and outputs the on clock or the off clock.

13. A method of driving a display panel, the method comprising:

generating, at a first step, a first start signal, an on clock, and an off clock;

generating, at a second step, a second start signal in synchronization with the first start signal, and generating gate clocks that swing to a predetermined voltage and have multiple phases, by using the on clock and the off clock, wherein the gate clocks are generated according to order determined on a basis of a number of pulses of the on clock or the off clock included in a vertical blank period; and outputting, at a third step, a scan signal sequentially to gate lines of the display panel by using the second start signal and the gate clocks, and supplying a data voltage to data lines of the display panel in synchronization with the scan signal.

14. The method of claim 13, wherein at the first step, a control signal in a pulse form is further generated in the vertical blank period, and at the second step, a start clock among the gate clocks is determined on the basis of the number of the pulses of the on clock or the off clock included in a first pulse of the control signal.

15. The method of claim 14, wherein at the second step, the gate clocks are generated according to order corresponding to forward driving, when there is no pulse of the on clock or the off clock within the first pulse, and the gate clocks are generated in reverse order by using, as the start clock, a clock having a first phase corresponding to the number of the pulses of the on clock or the off clock included within the first pulse.

* * * * *